US006443877B1

(12) United States Patent
Hoecht et al.

(10) Patent No.: US 6,443,877 B1
(45) Date of Patent: Sep. 3, 2002

(54) COMPACT, MULTI-CHOICE EXERCISE APPARATUS

(76) Inventors: Dietrich Hoecht, 455 Hoke O'Kelly Mill Rd., Loganville, GA (US) 30249; Fred Bohm, 3530 Pledmont Rd. Suite 12-J, Atlanta, GA (US) 30305

( * ) Notice: Subject to any disclaimer, the term of this patent is extended or adjusted under 35 U.S.C. 154(b) by 0 days.

(21) Appl. No.: 09/501,886

(22) Filed: Feb. 10, 2000

Related U.S. Application Data

(60) Provisional application No. 60/119,751, filed on Feb. 11, 1999.

(51) Int. Cl.[7] ..... A63B 21/062

(52) U.S. Cl. ..... 482/103; 482/138

(58) Field of Search ..... 482/93, 94, 97–103, 482/110, 134, 136, 138, 139, 909, 908

(56) References Cited

U.S. PATENT DOCUMENTS

| | | | | | |
|---|---|---|---|---|---|
| 372,272 | A | | 10/1887 | Murphy | |
| 776,824 | A | * | 12/1904 | Bryon, Jr. | 482/102 |
| 1,052,962 | A | * | 2/1913 | Reach | 482/102 |
| 3,373,993 | A | * | 3/1968 | Oja et al. | 482/102 |
| 4,603,855 | A | * | 8/1986 | Sebelle | 482/103 |
| 4,624,457 | A | * | 11/1986 | Silberman et al. | 482/98 |
| 4,657,246 | A | * | 4/1987 | Salyer | 482/94 |
| 4,721,303 | A | * | 1/1988 | Fitzpatrick | 482/103 |
| 4,898,381 | A | * | 2/1990 | Gordon | 482/103 |
| 5,044,629 | A | * | 9/1991 | Ryan et al. | 482/101 |
| 5,102,122 | A | * | 4/1992 | Piane, Jr. et al. | 482/133 |
| 5,230,680 | A | * | 7/1993 | Wu | 482/97 |
| 5,800,321 | A | | 9/1998 | Webber | |
| 5,842,961 | A | | 12/1998 | Davis | |
| 5,951,449 | A | * | 9/1999 | Oppriecht | 482/103 |
| 6,217,493 | B1 | * | 4/2001 | Spletzer | 482/103 |
| 6,238,323 | B1 | * | 5/2001 | Simonson | 482/102 |
| 2001/0023221 | A1 | * | 9/2001 | Simonson | 482/103 |
| 2002/0013200 | A1 | * | 1/2002 | Sechrest et al. | 482/98 |

FOREIGN PATENT DOCUMENTS

| | | | | | |
|---|---|---|---|---|---|
| CA | 524962 | | * | 5/1956 | 482/100 |
| EP | 177643 | | * | 4/1986 | 482/99 |
| FR | 1003973 | | * | 3/1954 | 482/98 |
| SU | 1586724 | A1 | * | 8/1990 | 482/103 |
| SU | 1743620 | A1 | * | 6/1992 | 482/102 |
| SU | 1780777 | A1 | * | 12/1992 | 482/102 |

* cited by examiner

*Primary Examiner*—Glenn E. Richmon
*Assistant Examiner*—Victor Hwang
(74) *Attorney, Agent, or Firm*—Barry E. Kaplan; Hughes & Kaplan

(57) ABSTRACT

Provided is a weighted cable resistance apparatus, primarily for rehabilitation and therapy, and equally effective for recreational exercising. A frame with a perpendicularly attached seat form a rigid structure. The structure is supported on leveling screws or lockable casters for transport to bed-confined patients. Dead weights within the frame and the rigid seat structure stabilize the apparatus against overturning during use of the apparatus. At each end of the frame is attached a horizontally pivotable assembly, called a 'module'. Each module contains weights which are, in turn, connected to a cable and to pulleys controlling the cable path. Vertically pivotable arms are mounted on the front of the is modules. The cables are guided to the end of the arms and past the exit pulleys, whereupon exercise tools can be connected. The twin module design provides simultaneous exercising with any two limbs. Horizontally and vertically selectable exercise tool positioning, and the freely rotating exit pulleys, offer unrestricted range of motion in a nearly hemispherical space. Additional features may be attached to the seat, such as a security stabilizer frame for unsteady users, and a disconnectable seat extension for exercising in a prone or supine position.

38 Claims, 19 Drawing Sheets

COMPACT, MULTI-CHOICE EXERCISE APPARATUS

RELATED APPLICATIONS

The inventors hereof claim priority based upon and pursuant to provisional patent application Ser. No. 60/119,751, filed Feb. 11, 1999.

FIELD OF THE INVENTION

This invention relates, generally, to weight resistance exercise machines; and, more specifically, to weight resistance exercise machines allowing a wide range of motion. The invention provides superior utility when used in association with physical rehabilitation and therapy programs.

BACKGROUND OF THE INVENTION

Weight exercises with machines dates from the $19^{th}$ century. Some are strictly for developing muscle strength and often limit the exercise to single muscles or muscle groups. Others permit motion only in one direction or a singular plane of motion. Virtually all current machines are designed only to enhance physical appearance; that is, to achieve a better body through muscle and strength development.

For physical rehabilitation after surgery and for most physical therapy, one needs to exercise with a wide range of motion. Such is a desirable feature for stretching and loosening muscle groups and also for providing increased joint movement and joint rotation.

Increased muscle strength is gained by increasing load resistance. For rehabilitation purposes, however, a fixed load resistance is usually desirable, rather than a load that increases during the flexure of a body part.

Exercise for a bedridden or a wheelchair confined person is difficult to achieve, since, very often, limbs and muscles are very weak from prolonged illness or recent surgery. That weakness requires the active support and bracing by another person, unless that exercise motion is limited to a vertical plane; that is, with and against gravitational force.

U.S. Pat. No. 372,272 to Murphy (Oct. 25, 1887) provides an example of early weight resistance designs, using weighted cables guided over pulleys on a pivoted frame. Although its use of weighted cables over pulleys are, after more than a century, still the dominant technique, the range of motion provided by that device is limited.

There have been alternatives to obtaining resistance with weights. For example, U.S. Pat. No. 4,620,704 to Shifferaw (Nov. 4, 1986) demonstrates a device that creates resistance with flexible rods of substantially equal cross-section over their length. This means that increased force is applied during bending deflection of these rods, as opposed to the constant force that is desirable for therapeutic exercise.

U.S. Pat. No. 5,733,229 to Berger (Mar. 31, 1998) uses a person's body weight to create resistance. Such an apparatus is not suitable for the weak or infirm, and is limited to exercising only a few muscle groups.

U.S. Pat. No. 4,721,303 to Fitzpatrick (Jan. 26, 1988) provides two independent mechanisms. While the handles can be located in four positions, they have limited adjustability with regard to both the horizontal and vertical. The range of motion provided by this device, further, is limited.

U.S. Pat. No. 4,898,381 to Gordon (Feb. 6, 1990) also provides two independent weight resistance mechanisms.

These mechanisms permit relocation of the handles from top to bottom and also horizontally. The apparatus is complicated, since the vertical sliding arrangement of the handle mounting frame requires an added floating pulley and weight assembly to compensate for changes in cable path length.

U.S. Pat. No. 4,603,855 to Sebelle (Aug. 5, 1986) also uses a compensating floating weight and pulley system, albeit to adjust for varying cable length from a horizontally sliding handle support arm, as compared to Gordon's referenced vertical slide assembly.

U.S. Pat. No. 5,800,321 to Webber (Sept. 1, 1998) uses only a single weight resistance mechanism. The exit pulley positions are limited, and only in a vertical plane with regard to a person who is seated. Other exercises require access to the rear of the apparatus, and the range of motion is very limited in that case.

In our youth-oriented society, the emphasis on developing a "better" body is not surprising. The prior art, however, neglects a pronounced demographic change: increased longevity. As people get older, their exercise-related activity requirements become quite different from "bodybuilding". For instance, they need preventative exercising, relieving of joint pains, and maintenance of flexibility, balance, and general conditioning. For this group of people, exercise is for health, not for appearance.

Another segment of an aging society are those who are physically impaired, handicapped, or bedridden. Some patients are forced to spend prolonged times in bed, requiring special care to prevent bedsores, muscle atrophy, reduced circulation, and gangrene. Very little exercise is available to those persons, other than by forceful assistance of a physical therapist. There is an obvious need for such exercise machines as may address each of those conditions; notably, since every year over 200,000 joint replacement operations are performed in the United States alone.

Some prior art does address exercise specifically for wheelchair confined persons. An example of such a device may be seen with reference to U.S. Pat. No. 4,747,595 to Mabry (May 31, 1988). That device, however, is not usable for the general aging populace, nor for persons with other impairments.

U.S. Pat. No. 5,842,961 to Davis (Dec. 1, 1998) stresses rehabilitation and therapy applications. It uses a single weight resistance mechanism with two swivel exit pulleys, one each at top and bottom. The upper pulley has partial vertical adjustment. There is relatively free and unrestricted range of motion in the vertical plane. The horizontal motion component is limited, however, since the limited vertical repositioning of the exit pulleys restricts force application in between the upper and lower exit pulley positions. Furthermore, exercise is limited to one limb at a time. A hinged security handrail can be lowered to the floor, but takes up much space. There is wheelchair access, but no provision for seated or seat extension exercising.

Generally, then, the prior art does not provide an exercise apparatus that optimizes functions and benefits to users, combining: versatility of use, ranging from recreational exercising at home to rehabilitation and therapy in clinical settings; simultaneous exercise with any two limbs or by two persons; widely adjustable positioning of force applicators, like handles, foot straps, and the like, according to the needs of the user, rather than strictly what the machine dictates; a desirable range of motion which is hemispherical, from overhead to floor, and with wide stretch horizontally; choice of exercising position, such as standing, sitting, prone, or supine on a seat extension; force application from all directions to allow rotation of body joints, like shoulder and hip, and, further, to allow linear extension or contraction or planar bending of body parts in any direction for selected muscles or muscle groups; support and bracing devices, such as rails and handholds for stabilizing and bracing for reaction forces; compact size to minimize the floor space required for the device, to permit stowage within a small volume, and to allow the device to be moved through a standard width door without disassembly; user friendly selection of force/weight settings, without requiring fidgeting to align holes for the setting pin between the specific weight plate and the lifting rod; unencumbered access to repositioning mechanisms for the force applicators (i.e. handles or footsteps) without impeding free access by placing structural members in front, by requiring unhooking and relocating force applicators, or by requiring a user to get down on his knees for access; mobility for easy transport from one room to another; easy wheelchair access; and, means to enable exercising for bed confined patients, in order to help post surgical and injury rehabilitation persons to move limbs and body, and to avoid bed sores and circulation problems caused by immobility.

It was as a result of the personal recuperation experiences from surgery by one of the inventors hereof, and in further recognition of the deficiencies of and within the prior art, that the present invention was devised. The present invention allows and fosters unrestricted movement during weight-resistance exercise. The benefits of unrestricted movement are known in the art to be successful in maintaining or increasing flexibility, and in somewhat reversing or slowing the effects of arthritis and other debilitating conditions. The present invention, on a different level, may prove beneficial when used in conjunction with physical therapy following orthopaedic surgery and in some injury cases. The present invention may find further application in fitness, recreational, or creative exercise.

Accordingly, the present invention provides a compact and versatile solution for needed exercise for the whole body and for persons with weakened physical condition.

Thus, among the several objects and advantages of the present invention are to provide an apparatus:

(a.) that can be used for muscle building and toning of most moving body parts, such as are typically associated with fitness exercisers. The constant force application in small increments, together with the wide range of spatial positioning of the force applicator devices, along with the mobility features of the apparatus combine to allow use for rehabilitation and therapy in a hospital environment; and, (b.) with versatility to exercise and move more than one limb at a time. The apparatus can also accommodate two persons exercising independently from each other. Other options are to combine the use of two force applicators in one handle or other such device; thereby, the available resistance force is doubled. Further versatility is gained by using one force applicator to statically support a limb or portion thereof, and by simultaneously using another force applicator to provide moving resistance force in the same or a different direction or plane of motion; and, (c.) that offers a nearly hemispherical space to position force applicators in the nature of the cable exit pulleys. Two sets of pivot locking mechanisms permit adjusting the position of the cable exit pulleys over a wide angle with respect to both azimuth and elevation. This creates a sweeping envelope of force applicator positions. Accordingly, the exercising person can face this envelope, position himself away from it, or remain within it, while being seated, when lying on the seat extension, or while in a wheelchair or bed that is located near it; and, (d.) that permits great freedom for the exercising person to pick certain positions for moving specific body parts. A person, thus, can stand while moving arms forward or backward, or while bending the upper body forward or backward. One arm and one leg can be moved simultaneously. The person also can stand with his side positioned toward the apparatus. Exercise from a seated position offers similar flexibility; for example, when the seat extension is used in association with the apparatus, a person can exercise while lying supine or prone, while facing the apparatus or looking away; and, (e.) that allows the exercise force to be applied from all directions, within the usable operating hemisphere of the apparatus. This is made possible by permitting a cable exit pulley to swivel freely through 360 degrees, and by guiding the cable through the pivot center of the swivel assembly. The cable exit pulley thereby follows the direction of applied external force. This, in turn, allows unrestricted movement by the exerciser. It is he who controls the apparatus, not vice versa, as in many prior art devices; and, (f.) whereby the exercising person remains stabilized, reassured, and securely braced against the reaction forces and movement from the exercise. A handrail can be unfolded from its storage location and locked into place to assist a standing person. Removable handholds can be used when the seat extension is used. The handholds are attached to both sides of the seat extension, and one or both hands can grasp the handholds in order to counter the exercising forces; and, (g.) that is confined to a small footprint. In homes and in clinical settings, a large exercise machine often cannot be accommodated. The present apparatus contains extra dead weight, the sole purpose of which is to provide the necessary margin of stability against overturning forces, even at maximum force application. In contrast, many prior art devices use an outrigger structure for such stabilization. Such a structure is disadvantageous in that it not only results in substantial floor space being taken up by the device, but also the outrigger poses a trip hazard for the operator. The footprint and overall room volume utilized by the present invention can further be minimized by choosing specific settings for the azimuth and elevation locking mechanism; e.g., a toe-in positioning in the azimuth and the lowest position in elevation. The seat extension is detachable and its legs can be folded. It, further, can be stored upright atop the seat; and, (h.) that provides a user-friendly way of changing the force setting through selecting the number of weights to be raised. The commonly practiced design uses the so-called L-pin for interlocking a weight plate with the weight anchor rod. The pin is awkward to maneuver, and often requires fidgeting to achieve alignment of the holes. The present invention uses a formed dual function spring wire that is inserted into a gap between weight plates. An easy-to-grip handle and spring assembly is guided to snap onto the weight anchor rod. This assembly, further, automatically levels the weight stack that it supports. This design eliminates the conventional pair of vertical guide rods, along with the associated precision machining and costly assembly; and, (i.) that provides ergonomic and easy access for repositioning of the force application cable exit pulleys and of the various locking mechanisms. Both the elevation and the azimuth locking mechanisms are at waist height and are readily reached without awkward body movement. The elevation locking mechanism uses a spring loaded plunger that engages automatically when aligned with a hole at the desired position. Accordingly, it is not required that the operator remember to secure the mechanism; thereby, minimizing the chances for an accident; and, (j.) that is easily moved about. A home or clinical facility rarely permits much space for an exercise machine, which typically must remain fixed in one place. The present invention provides swivel casters for mobility. The apparatus can readily be passed through a typical width door opening; and, (k.) that is convenient for use with a wheel chair. A strap attachment can be used to lock a wheelchair against the seat structure; thereby, stabilizing the exercising person against roll-away and annoying movement; and, (l.) that gives bedridden persons the possibility to actively and passively experience exercise. Preventative motion can avoid bedsores and improve blood circulation. Specifically prescribed exercise may speed healing and recovery after bone, joint, or muscle repair surgery. Accordingly, the apparatus permits raising and support of a weak person's limb at a short distance above the mattress, and, with the assistance of a physical therapist, provides force resistance exercise in a horizontal plane. Such an exercise is not known to be possible with any prior art device.

It, therefore, is readily apparent that such an invention will provide heretofore unknown benefits over the prior art devices. Accordingly, still further objects and advantages of the present invention will become apparent through reference to the ensuing Detailed Description of the Preferred Embodiment and to the several drawing Figures.

SUMMARY OF THE INVENTION

The invention comprises a weight resistance exercise apparatus having applications that range from recreation to rehabilitation and therapy. Attached to each end of a frame is a module. Associated with the frame is a seat. Each module contains a weight and pulley and cable mechanism. The mechanism comprises weights, which are is connected to a cable, and pulleys controlling the cable path. Both modules are horizontally rotatably adjustable. Cable exit arms are vertically rotatably adjustable, and cable exit pulleys are free to swivel. The twin module design provides simultaneous exercising with any two limbs. Horizontally and vertically selectable exercise tool positioning, along with the freely rotating exit pulleys, offers unrestricted range of motion in a nearly hemispherical space. The entire structure is supported on leveling screws or lockable casters, enabling transport to bed confined patients. Dead weights within the frame and the rigid seat structure stabilize the apparatus against overturning forces during use of the apparatus.

Additional features may be attached to the seat. Such additional features comprise a retractable security stabilizer frame for unsteady users and a disconnectable seat extension for exercising in a prone or supine position.

In combination, these features allow unrestricted movement and exercise force application in a nearly hemispherical space. Portability, along with wide ranging accessibility of the exercise tools, allows even bed-confined patients to exercise in a physically productive and beneficial manner.

BRIEF DESCRIPTION OF THE DRAWINGS

The invention will be further understood by reading the Detailed Description of the Preferred Embodiments with reference to the accompanying drawing Figures, in which like reference numerals denote similar structure and refer to like elements throughout, and in which.

It is to be noted that the drawings presented are intended solely for the purpose of illustration and are, therefore, neither desired nor intended to limit the invention to any or all of the exact details of construction shown, except insofar as they may be deemed essential to the claimed invention.

DETAILED DESCRIPTION OF THE PREFERRED EMBODIMENT

In describing the preferred embodiment of the present invention illustrated in Figures, specific terminology is employed for sake of clarity. The invention, however, is not intended to be limited to the specific terminology so selected, and it is to be understood that each specific element and step includes all technical equivalents which operate in similar manner to accomplish a similar purpose. It will be appreciated that the use and application of the present invention may be varied as to its configuration, and with further regard to details of the mechanisms and steps presented, and the materials employed, all without departing from the scope of the basic invention disclosed herein.

Figure 1:
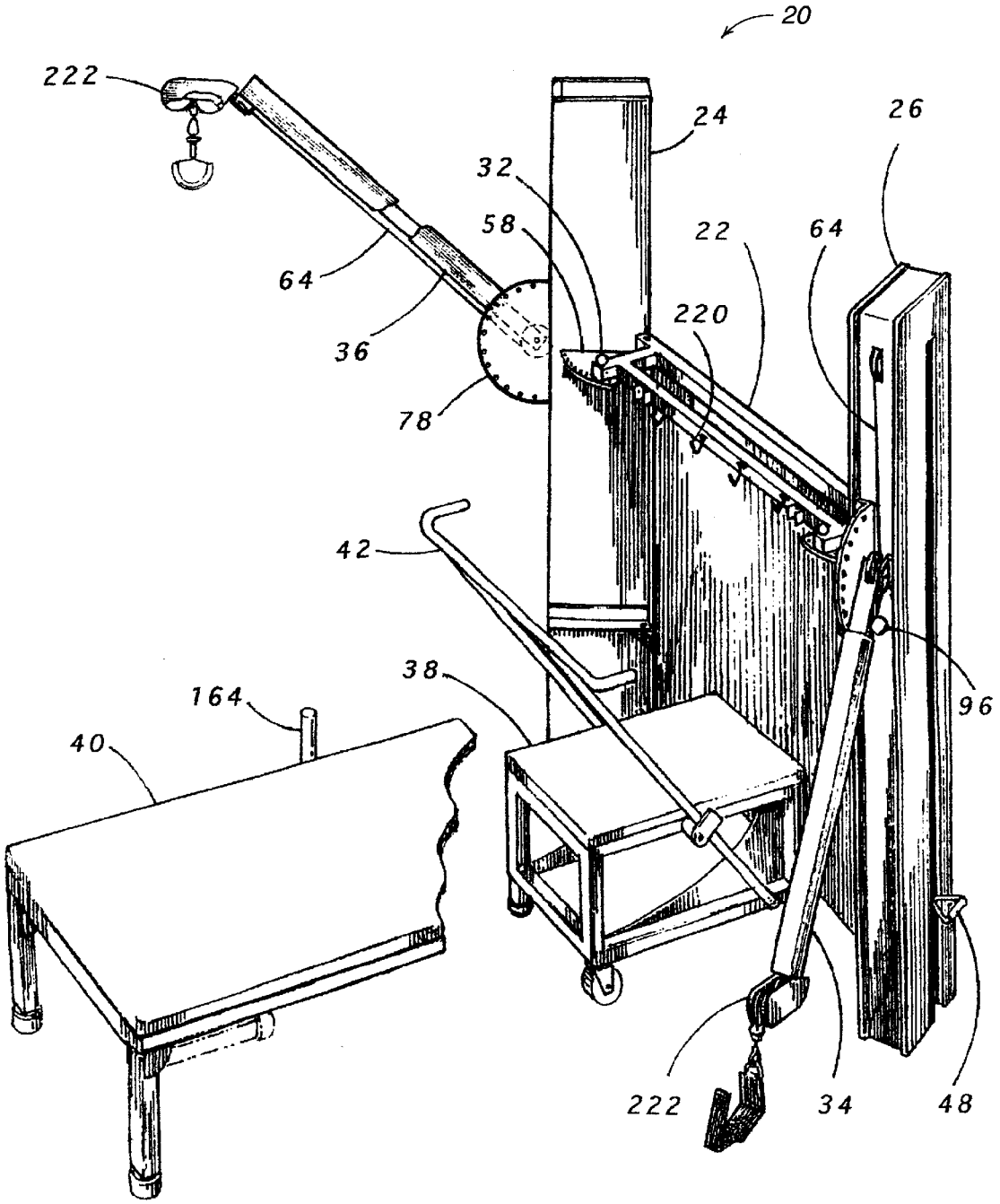
FIG. 1 is an overall view of the exercise apparatus of the present invention.
Figure 6:
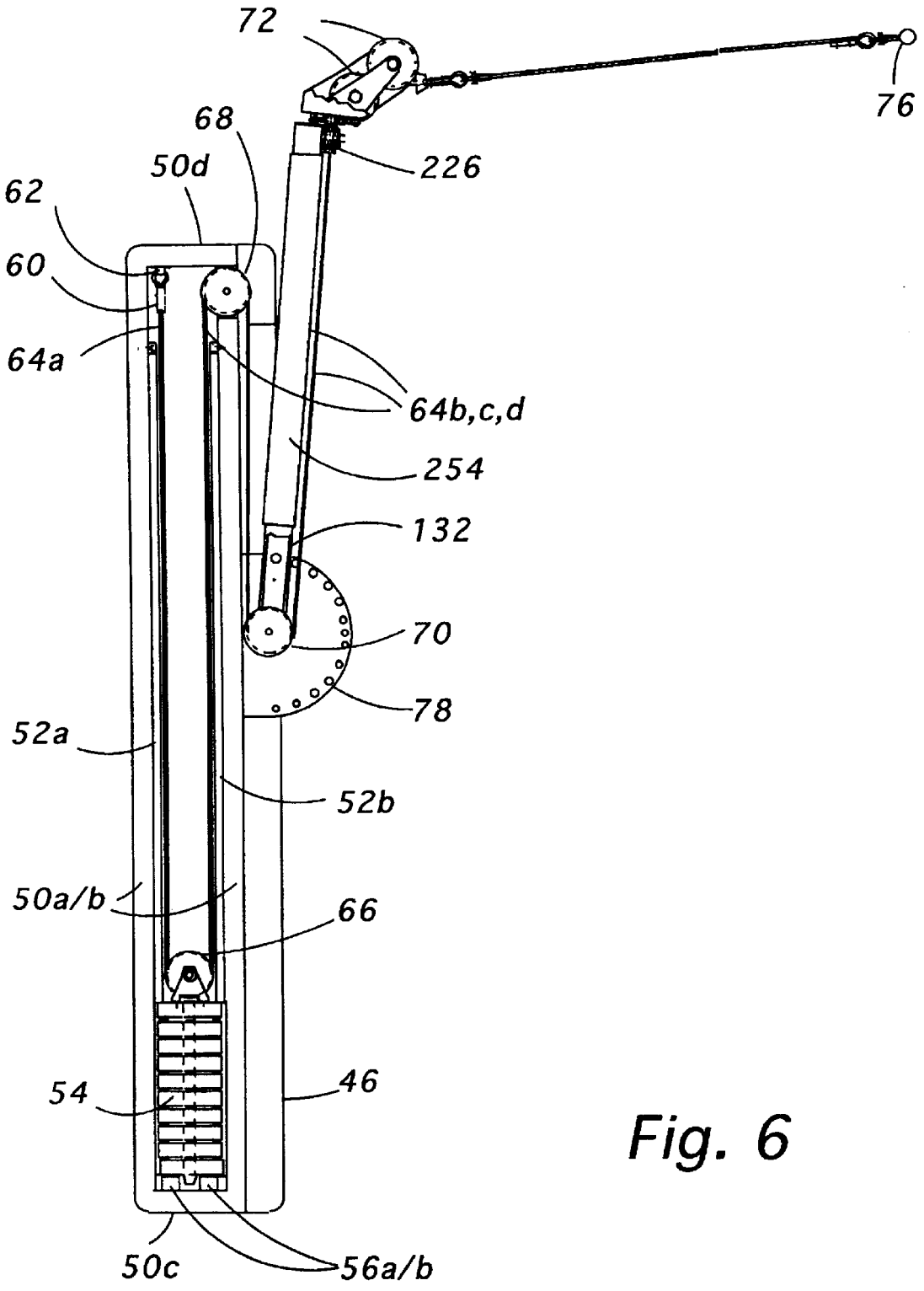
FIG. 6 is a sectional view of the left hand module of the exercise apparatus of the present invention, further showing the arm and an exercise handle.

Provided now with reference to FIGS. 1 and 6 is an overall description of exercise apparatus 20 of the present invention. The major subassemblies of apparatus 20 include frame 22 with seat 38. Frame 22 is best described as a flat, rigid frame, containing dead weights 208, discussed in further detail with reference to FIG. 3, counteracting destabilizing forces created by the use of apparatus 20. Seat 38 is best described as a three-dimensional structure for sitting, and is perpendicularly attached to frame 22, further stabilizing apparatus 20.

Modules 24, 26 are best described as six-sided framework pivotably attached to said frame 22. The position of each module 24, 26 is selectable in a horizontal plane. Modules 24, 26 contains weight plates 54, best seen with reference to FIG. 6, the weight selector devices 48 to select the number of weights 54 to be raised, the connected wire cable 64 and the pulleys 68, 70, best seen with reference to FIG. 6, guiding the cable 64 to termination beyond the cable exit guide pulleys 72, again, best seen with reference to FIG. 6.

Figure 4:
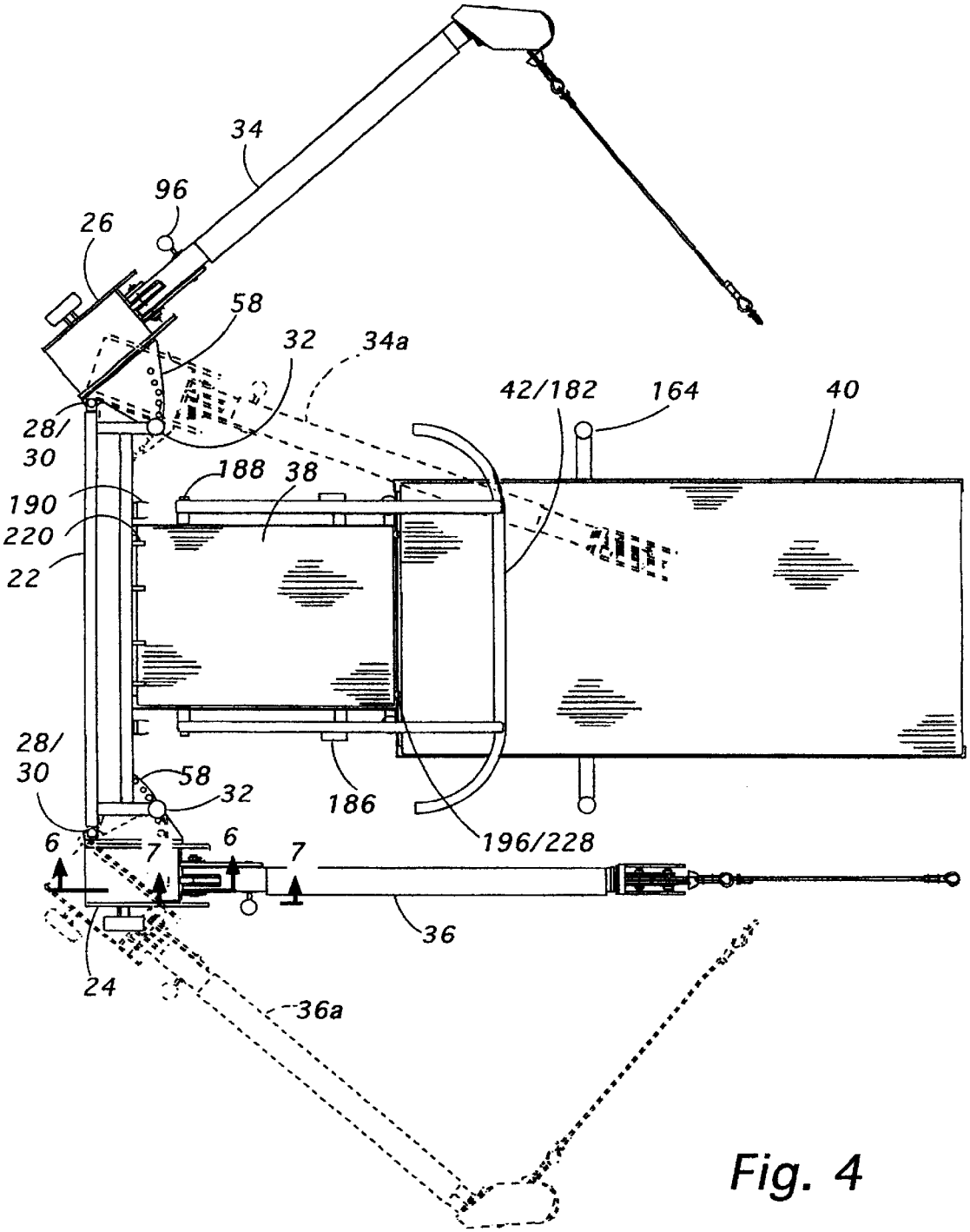
FIG. 4 is a top view of the exercise apparatus of the present invention, further showing various azimuthal positions of the modules.

As can best be seen with reference to FIG. 4, modules 24, 26 are pivotally attached with hinge pins 28, 30, and locked in a position setting with locking pin 32 and azimuth locking plate 58, as needed for specific exercises.

Best seen with reference again to FIGS. 1 and 6, arm assembly 34, 36 is best described as preferably tubular pivot arm 132, containing pulley 70, plunger lock assembly 96 and exit pulley assembly 222. Arm assembly 34, 36 serves to route wire cable 64 from under pivot guide pulley 70 through the swivel center 226 of the exit swivel assembly and in between exit pulleys 72. Arm assembly 34, 36, is attached to the front of each respective module. Both arm assemblies are capable of being set in variable orientation about horizontal pivots and lockable with plunger lock assemblies 96 against a semi-circular elevation locking plate 78. Swivelable exit pulley assembly 222 turns the wire cable 64 into the direction of the applied external tension force. Various exercise tools 74, 76, 210, 224 are machine-user interfaces. Exercise tools are best described as devices, such as handles, bars, leg and foot straps, and the like, used to perform exercises. They are attached to the end of wire cable 64.

The apparatus 20 is to have certain proportions to achieve near hemispherical range of motion and to permit the various stances and positions of the exerciser, as described herein. Such geometric proportions define the length of the arm assemblies 34 and 36 as reaching from their pivot axis to near the floor in their lowest positions. Further, and best seen with reference to FIG. 3, the width between the azimuth hinge pins 28, 30 centers on both sides of frame 22 and, preferably, is less than the length of arm assembly 34, 36. Further, the usable and extractable cable length out of each swivel assembly preferably is greater than the length of each arm assembly 34, 36.

Built-in stabilizer frame 42 can be used for steadying an exerciser. Stabilizer frame 42 is best described as including a handle bar 182 and being pivotably attached and lockable to seat 38, and, further, being retractable against frame 22. Stabilizer frame 42 also serves as reassurance for the exercising person, since reaction forces are transmitted through this frame. For exercising in prone and supine positions a detachable, collapsible seat extension 40, best seen with reference to FIG. 4, can be connected to the seat 38 via eye receptacle 196 and hook 228.

Figure 2:
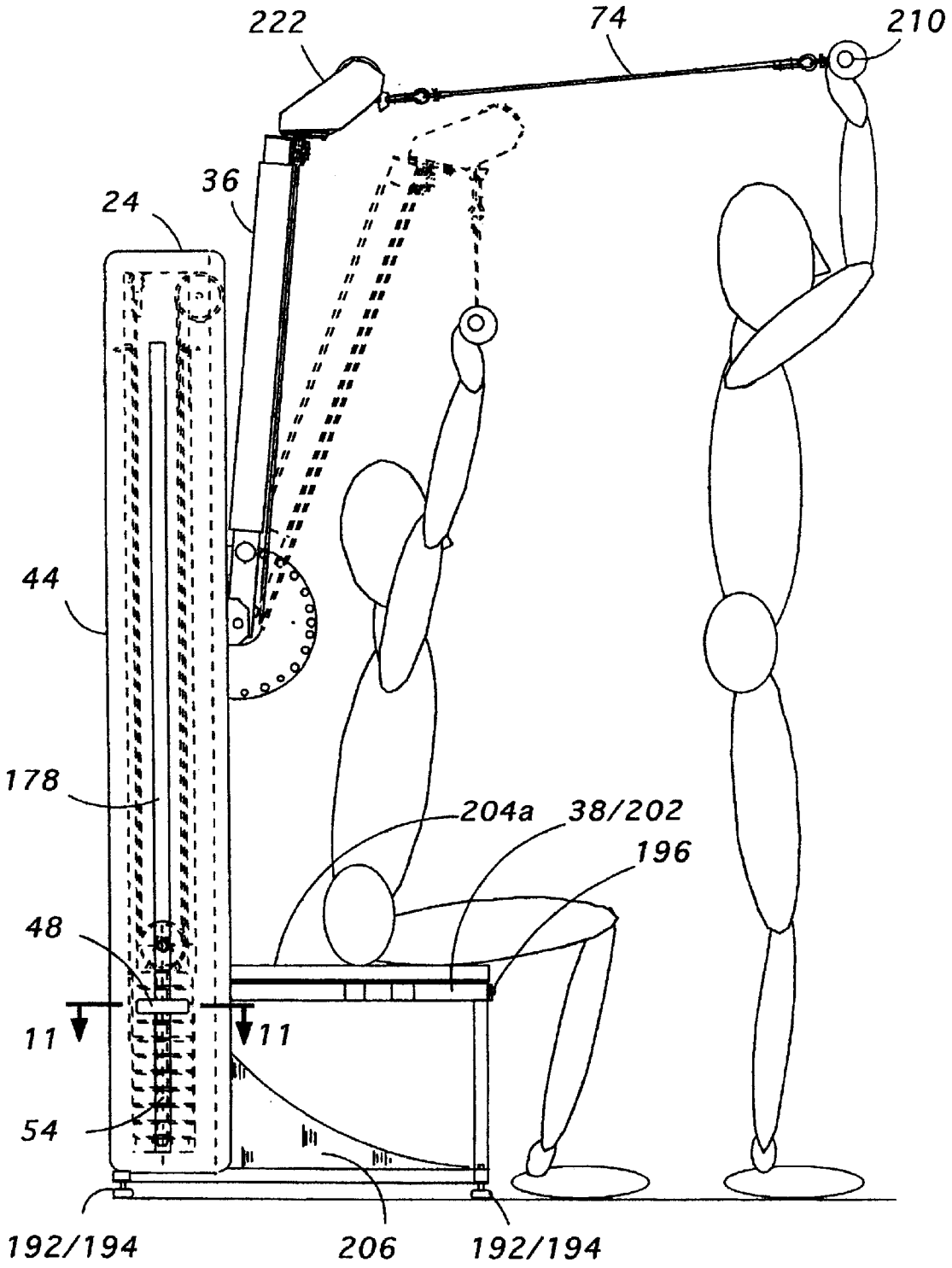
FIG. 2 is a side view of the exercise apparatus of the present invention, further showing a person in two alternate exercise positions.

To insure stability of the entire apparatus 20 while external overturning loads and horizontal rotational loads are applied, frame 22 has four widely spaced leveling screws 192 with elastomer pads or feet 194, best seen with reference to FIG. 2. The entire weight of apparatus 20 stabilizes against overturning moment loads. In the case of horizontal forces applied to a substantially horizontally positioned arm assembly 34, 36, a torsional moment is created about an imaginary vertical axis. This axis is centered between the four leveling feet 194. The friction force reactions resulting from the vertical weight distribution onto the four elastomer pads 194 of the leveling screws 192 provide torsional stability about this imaginary vertical axis of rotation. A sufficiently high coefficient of friction between the elastomer pads 194 and the floor is provided for creation of such horizontal friction forces. Exercise apparatus 20, thereby, is safely stabilized and need not be attached to a floor or wall.

The four leveling screws 192 are contained within the footprint of apparatus 20, including the seat 38; therefore, they do not pose a trip hazard for anyone near apparatus 20. For making apparatus 20 mobile for transportation to bed-confined patients and otherwise, the leveling screws 192 may be replaced by lockable casters 198/200, best seen with reference to FIG. 14, casters 198/200 having similar sliding friction properties as elastomer pads 194 of the leveling screws 192. In order to compensate for differing mounting heights, a preferably tubular spacer may be inserted between the bottom of seat 38 and leveling screws 192. In this fashion, the height of seat 38 is maintained.

For stowage during non-use, modules 24, 26 can be pivoted inward, toward the center of frame 22. The arms 34, 36 are folded downward, and stabilizer frame 42 can be unlocked by loosening the latching lock 186, best seen with reference to FIG. 3, from the frame of seat 38 and by being pivoted and leaned against the center frame 22. Seat extension assembly 40 is detached, oriented vertically, then lifted onto seat 38 and leaned against frame 22. Accordingly, an assembly is created which is compact and neat when not in use.

Hooks 220 can be used for temporary storage of exercise tools and other items of choice. For prone or supine exercising, seat extension 40 has handles 164. Handles 164 selectively can be used as handholds for reacting forces, which are mostly applied through the legs. This also may be seen with reference to FIG. 13.

Arm assemblies 34, 36 used in conjunction with foot straps 224, provide means to suspend one or two limbs. In this configuration, the cable force partially or completely compensates for gravity, while the exerciser is able to move the same limb in any direction, including through planar or spatial rotation.

Figure 16:
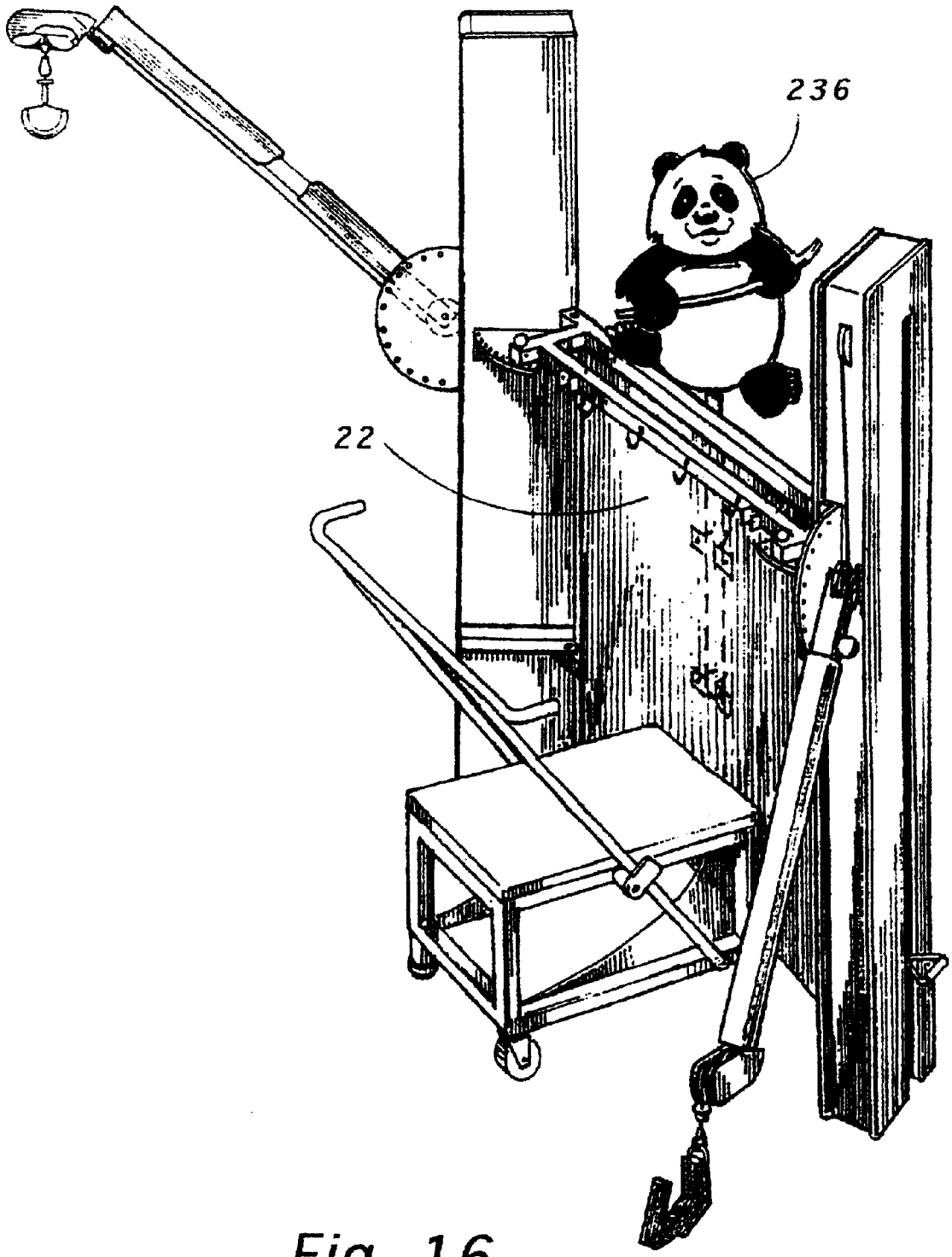
FIG. 16 is a view of the exercise apparatus of the present invention with a panda bear image to counter possible apprehensions toward such exercise mechanisms by children.

In clinical settings, where children may be apprehensive of such an exercise apparatus 20, the apparatus may be equipped with attachments. FIG. 16 demonstrates the image of a friendly cartoon FIG. 236, a panda bear. FIG. 236 may be a painted or otherwise decorated panel cut-out, attached to frame 22.

In contrast with the typically severe look of the exposed parts of some prior art, the weight and cable mechanism, which is inside modules 24, 26, is covered by decorative panels. The panels can be of any material, finish, or color—whatever is appropriate for the setting, be it clinic or home.

Safety is addressed by wrapping the protruding arms 34, 36 in soft safety wrap 254, best seen with reference to FIG. 6, and by covering the sides of the otherwise exposed exit pulleys 222 with shields 256, best seen with reference to FIGS. 10. The overall design for the stability of apparatus 20 avoids outriggers, which constitute a trip hazard. Further, the locking plunger assemblies 96 on the arm assemblies 34, 36 are spring loaded; thereby, self-engaging in the holes of the elevation locking plates 78. This feature prevents accidental dropping of the arm assemblies, after a potentially careless position adjustment.

Ergonomic design places the adjustment locks for azimuth positioning of modules 24, 26, as well as for elevation positioning of arm assemblies 34, 36 at convenient waist height and within easy reach. Weight selection for the desired exercise force is also readily accessible at both sides of the apparatus. A snap-in weight selector 48 with handle is placed underneath the desired weight stack. This method of weight selection is accomplished without the fidgeting and problems of hole alignment, as is typical with the pin-and-hole engagement of most prior art designs.

Referring now to FIG. 2, a side view of apparatus 20 is shown. Two alternate positions of the arms 36 with exit pulley assemblies 222 are shown. FIG. 2 also depicts a person seated and standing, facing away from apparatus 20. In both cases the exercise takes the form of arm and shoulder movement in a forward and downward-forward direction.

Module 24 with outer panel 44 shows vertical slot 178. Vertical slot 178 permits movement of weight stack 54, or selected portions thereof, during exercise. Weight selector 48 is used to select the number of additive weights 54 that will be lifted. Weights 54 comprise the resistance weights for the cable and interface handle assembly 210 pull force. Cable extender 74 is used to allow full extraction of the built-in usable length of the cable 64 while a person is positioned away from the close proximity of apparatus 20. Seat 38 may be covered with cushion 204. Side panels 206 stiffen and strengthen seat frame 202, which forms an integral part with frame 22. Front and rear leveling screws 192 with elastomer pads 194, or, alternately, with casters 198, support the entire apparatus 20. Eye receptacles 196 permit secure and rigid attachment of seat extension 40.

Figure 3:
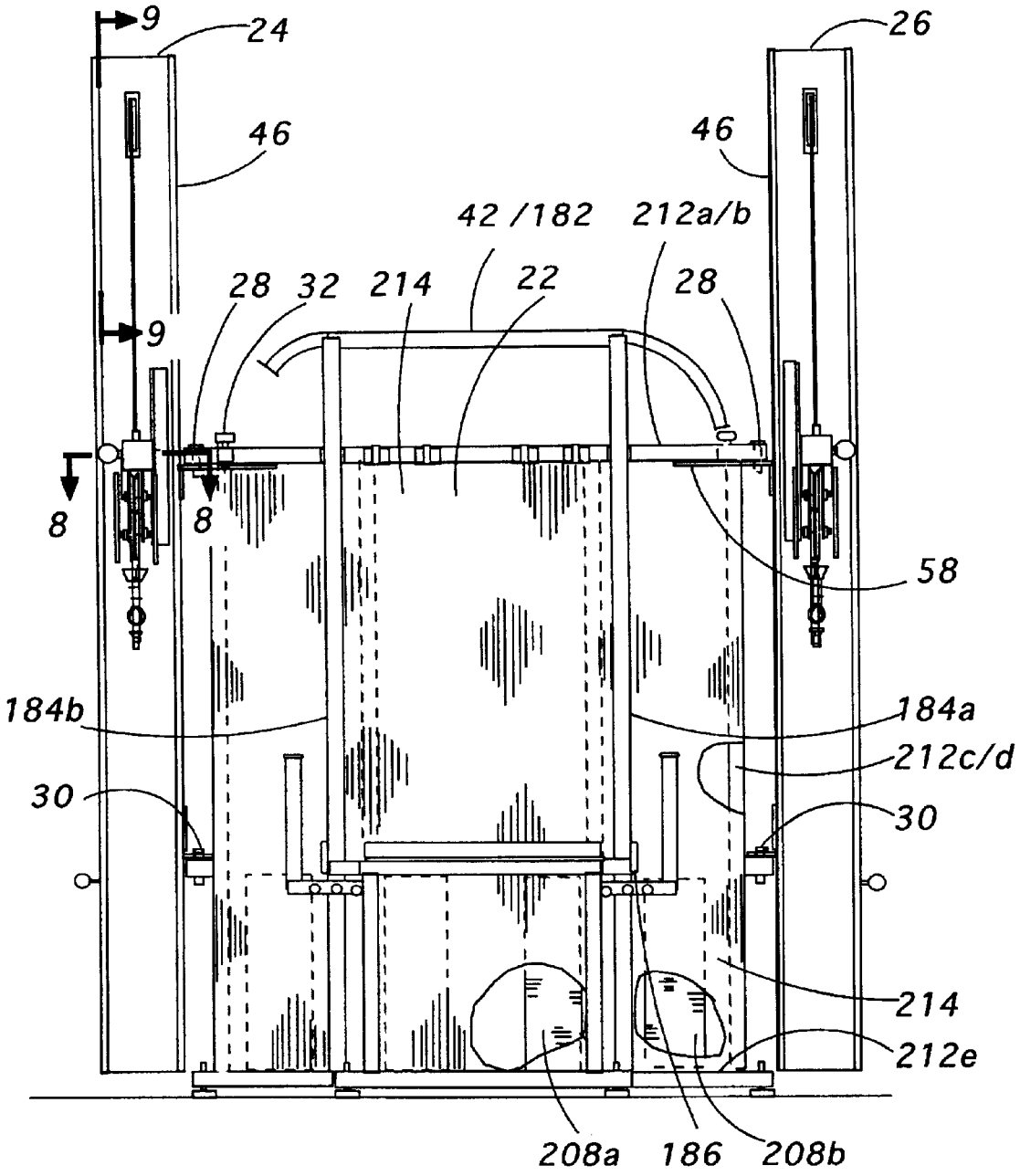
FIG. 3 is a front view of the exercise apparatus of the present invention.

Referring now to FIG. 3, a front view of apparatus 20 shows, to the left and right of the frame 22, modules 24, 26 positioned at right angles to frame 22. Stabilizer frame 42 is rotated into stowage location. Stabilizer frame 42 consists of a handle bar 182 and two structural frame members 184, which are located some distance away from the seat frame. Frame members 184 lock to the seat structure via toggle latch locks 186 or similar such mechanism known in the art. The stabilizer frame 42 is hinged against the lower frame members of the seat 38.

The mounting arrangement of modules 24, 26 to the frame 22 shows upper and lower hinge pins 28, 30. These hinge pins 28, 30 transfer weight and externally applied reaction forces from the modules 24, 26 to frame 22. Locking pins 32, together with azimuth locking plates 58, allow the establishment of the module azimuth position. The locking plates 58 structurally are attached to the module inner panels 46. They also transfer from the respective module the rotational moment loads about a vertical axis as horizontal shear forces through upper hinge pin 28 and locking pin 32.

Various frame members 212 comprise the skeleton of frame 22. Counterweights 208 are mounted to these frame members 212. Frame panels 214 may be used to cover the frame skeleton. Panels 214 may be used as sandwich skins, in order to impart strength and stiffness, and also may serve as decorative elements.

Referring now to FIG. 4, shown is a top view of apparatus 20 wherein a typical range of the module position settings can be seen. This range is shown relative to the center of the seat and seat extension center line. It will be appreciated that the useful range can be adjusted within the constraints of apparatus 20 to accommodate varying requirements for use. The outermost positions, demonstrated by arm assemblies 34, 36*a* illustrate the range of motion available for horizontally stretched limbs. The innermost positions, demonstrated by arm assembly 34*a*, shown are particularly useful when tying a common handle bar to both cable exit ends, and, also, when specific exercises are chosen, as better seen with reference to FIG. 15. A common handle bar permits combining and maximizing the available forces from both cables, and, thereby, from the modules. In such case, the same weight settings would be used in both modules.

Seat extension 40 is shown attached via receptacle and hook 196/228 to seat 38. Stabilizer frame 42 is unstowed and fixed in place with latch lock 186. Hinge assembly 188 mounting against the seat frame is indicated. For the stowed position, receptacle clips 190 tie stabilizer frame 42 to frame 22.

Figure 5:
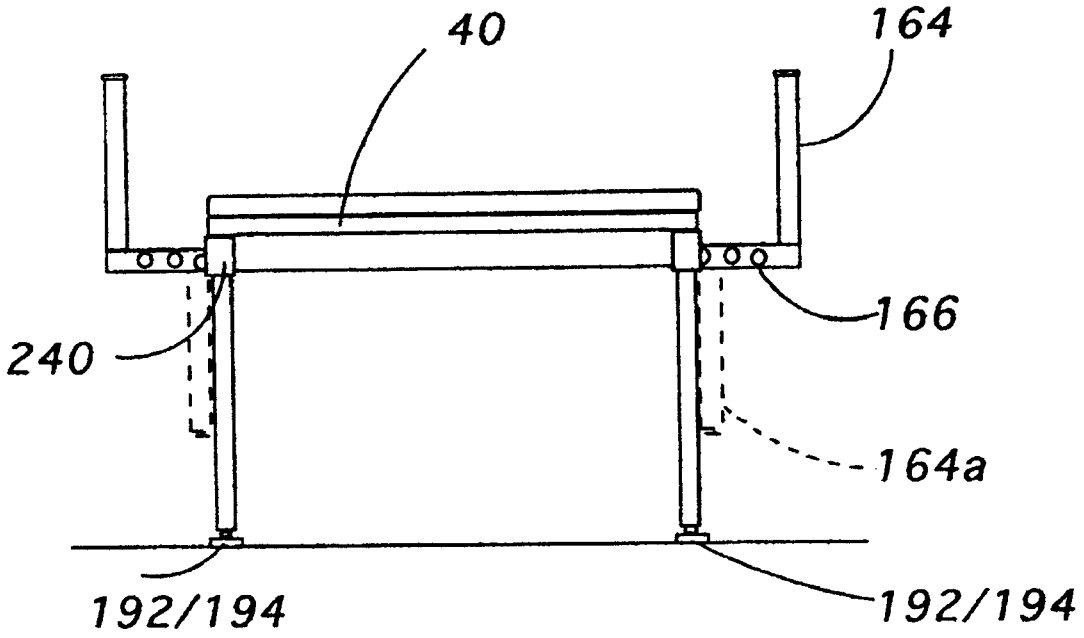
FIG. 5 is a front view of the seat of the exercise apparatus of the present invention.
Figure 13:
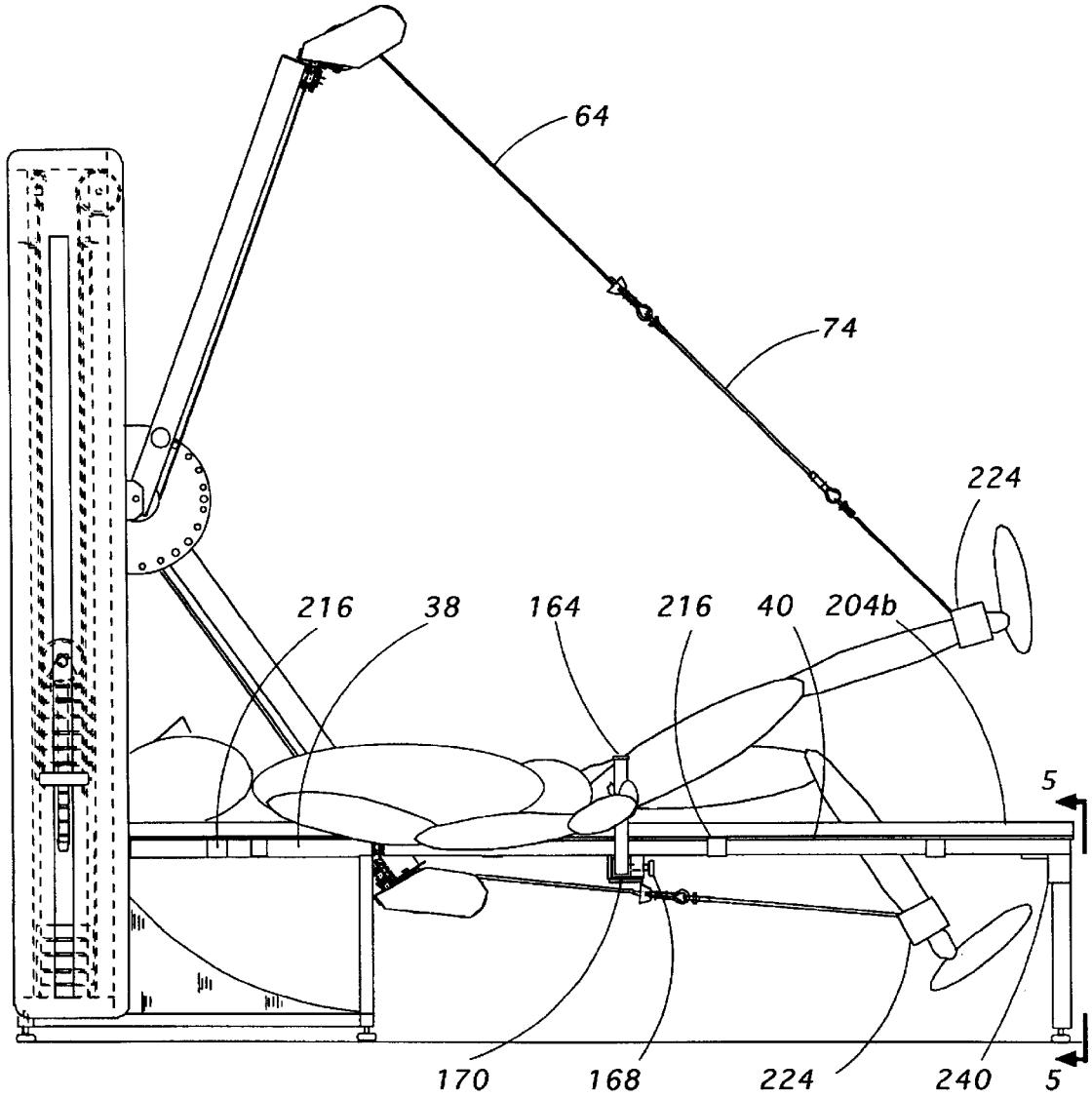
FIG. 13 is a side view of the seat and the seat extension of the exercise apparatus of the present invention in use, showing two exercises for legs.

Turning next to FIG. 5, shown is an end view of seat extension 40. Leveling screws 192 and leg folding hinge 240 are part of the seat extension structure. Handles 164 are slideably mounted on both sides of seat extension 40. Index holes 166 allow several settings. When not in use, handles 164 can be slid out of their tubular receptacles, then repositioned and stowed in an inverted position 164*a*. Other features attendant to the seat extension and the handle mounting arrangement are shown in FIG. 13.

Referring again to FIG. 6, an individual module with routing of the wire cable 64 is illustrated. The outer panel is removed to expose the interior of the module. Inner panel 46 is visible, as well as the module frame parts 50*a* through 50*d*. The stack of weights 54 rests on spring cushions 56*a*/*b*. Weights 54 slideably move upward and downward on the weight guides 52*a* and 52*b*. One end of cable 64 with cable fitting 60 is fixed with attachment fitting 62 to the upper module frame 50*d*. Cable 64 is strung via weight pulley 66, over upper guide pulley 68, and downward to pivot guide pulley 70, through swivel center 226 of exit pulley assembly, over the exit guide pulleys 72. It is noted that the cable and pulley arrangement provides a 2:1 ratio for effective cable forces and travel, versus weight and weight travel. Exit cable travel is twice the weight vertical travel. Cable exit tensile force on handle 76, therefore, is half of the set weight in pounds.

Tubular pivot arm 132 is covered with soft safety wrap 254 to prevent accidental injury to someone bumping into the protruding arm.

Other parts of the weight stack and the arm assembly are detailed in FIGS. 7, 8 , 9, 10 and 11.

Figure 7:
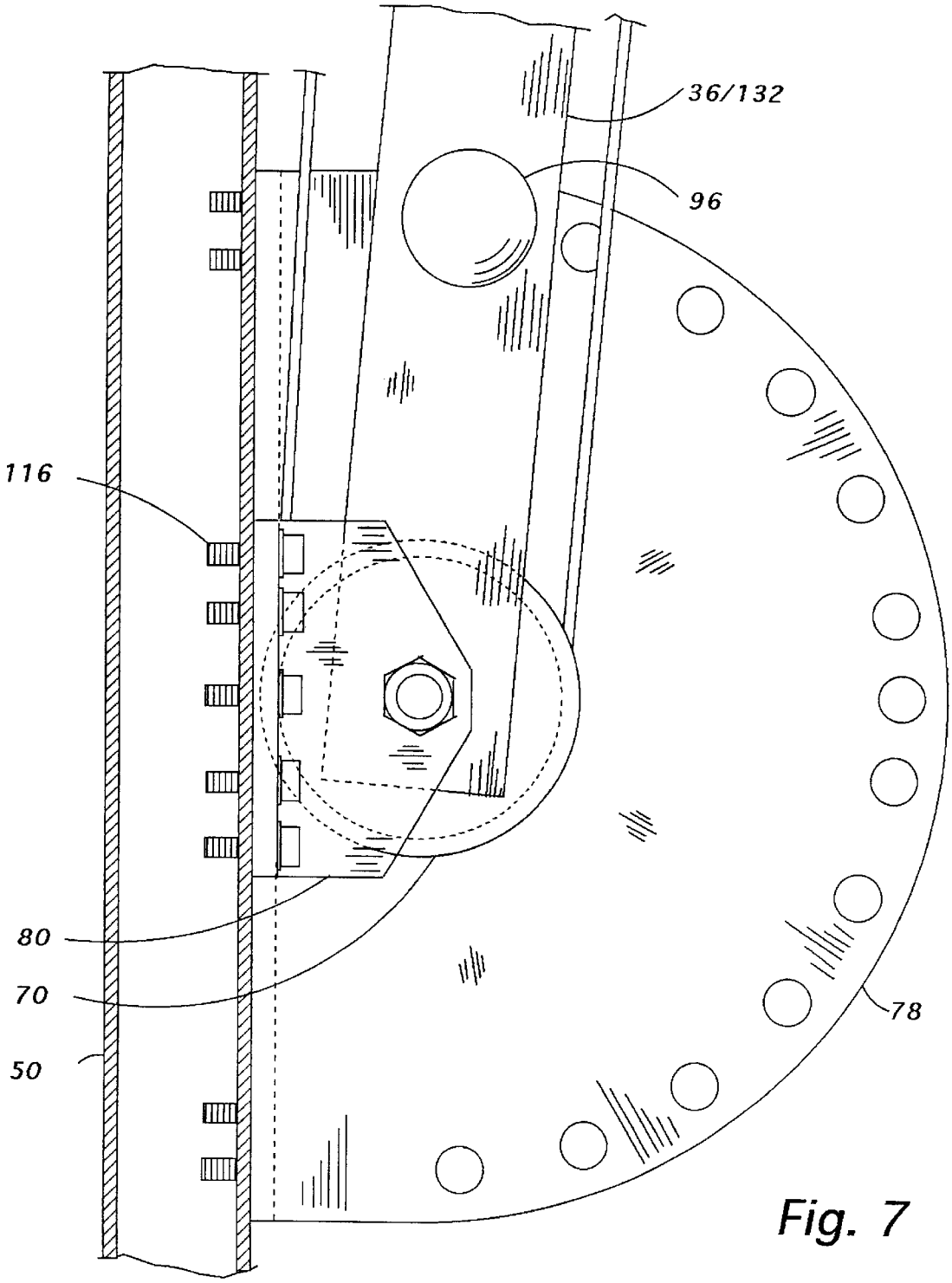
FIG. 7 is a sectional close-up of the arm pivot assembly of the exercise apparatus of the present invention.
Figure 8:
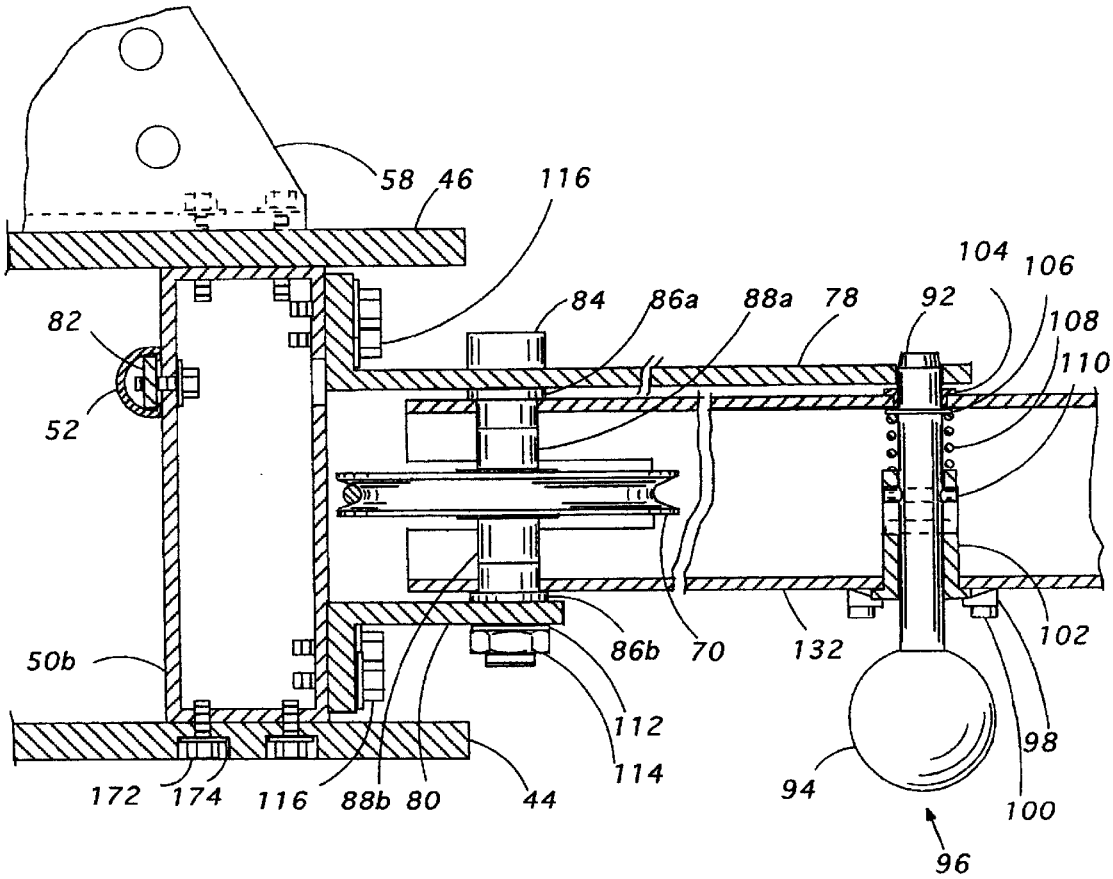
FIG. 8 is a cross-section of an arm pivot assembly and an elevation pivot lock of the exercise apparatus of the present invention.

FIG. 7, together with FIG. 8, gives a close-up of the elevation pivot and locking mechanism of arm assembly 36. Plunger lock assembly 96 engages pivot arm 132 in the index holes of the elevation locking plate 78. The reaction loads from the arm pivot and the locking assembly are transferred via several screws 116 to the module frame. One side of the pivot is supported by the locking plate, the other by pivot bracket 80.

A cross-sectional view of the arm pivot and locking assembly is shown in FIG. 8, together with a partial section through the module. Plunger lock assembly 96 is spring loaded and permanently affixed to pivot arm 132, so that locking pin 92 will always self-engage in an index hole of locking plate 78. In this way, even if the arm is momentarily positioned such that it does not mate with an index hole, it will snap and lock into place once an additional rotation to the nearest index hole is made. This spring loaded feature provided as a safety consideration to prevent the arm assembly from accidental uncontrolled dropping.

Plunger lock assembly 96 comprises locking pin 92 with ball grip 94. It is used to retract pin 92 out of engagement. Flanged bushing 102 has a slot milled into it, thereby permitting limited axial movement of pin 92. The travel limits are set by pin 110, which is inserted into locking pin 92. Compression spring 108 reacts against bushing 102, and provides the force pre-load onto locking pin 92 via spring ring 106. Bushing 104 guides locking pin 92, and transfers the shear loads from locking pin 92 to pivot arm 132. Clips 98 and screws 100 fasten the locking pin assembly to the arm by clamping the flange of bushing 102.

The arm pivot consists of shoulder pin 84, two flange bushings 86, two spacers 88, center-placed pivot guide pulley 70, flat washer 112, and lock nut 114. The pivot assembly is supported by pivot bracket 80 and L-shaped elevation locking plate 78.

The forces from the pivot supports are transferred through screws 116 to module frame member 50*b*, to inner module panel 46 and azimuth locking plate 58. Elements of weight guide 52 with nut strip 82 can be seen. Outer module panel 44 is readily removable. Screws 172 with flat washers 174 are attached to the module frame 50*b*, and is permit easy alignment with the panel mating holes. The panel is counter bored for recessed placement of screws and washers, in the interest of clean design.

Figure 9:
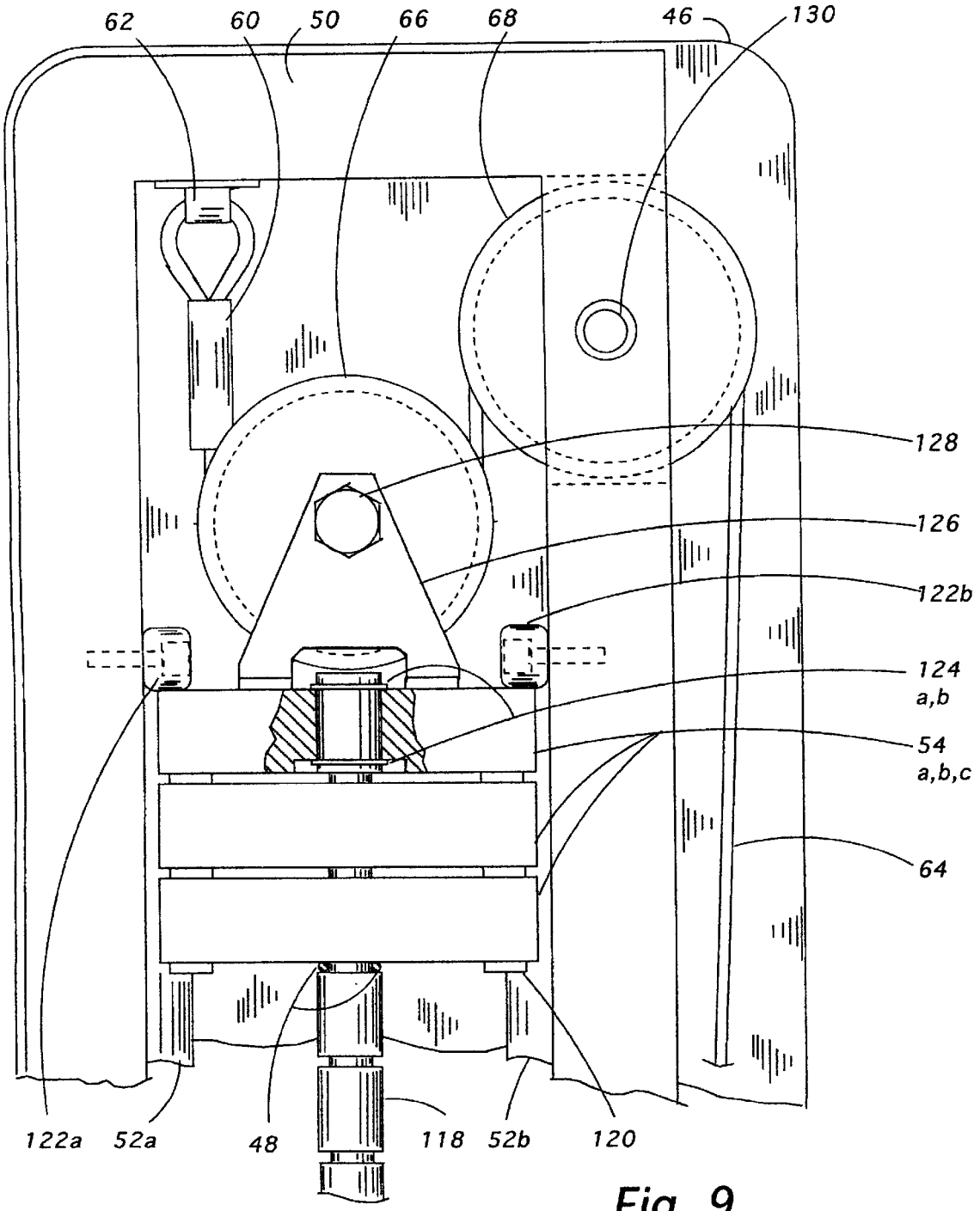
FIG. 9 is a close-up view of the upper part of a module of the exercise apparatus of the present invention with panel removed.

FIG. 9 provides a close-up view of the module, with the outer panel removed. In this case, the weight stack has been moved to its uppermost position; that is, wire cable 64 at its exit point is fully extended. Cable attachment fitting 62 attaches to module frame 50 and cable fitting 60 affixes the cable on the other end. Upper guide pulley 68 is mounted with its axle assembly 130 within a cut-out of frame 50. The cable is routed from its fixed mounting underneath weight pulley 66 over upper guide pulley 68 to the outside of the frame, and down to pivot guide pulley 70, better seen with reference to shown in FIG. 7.

Figure 11:
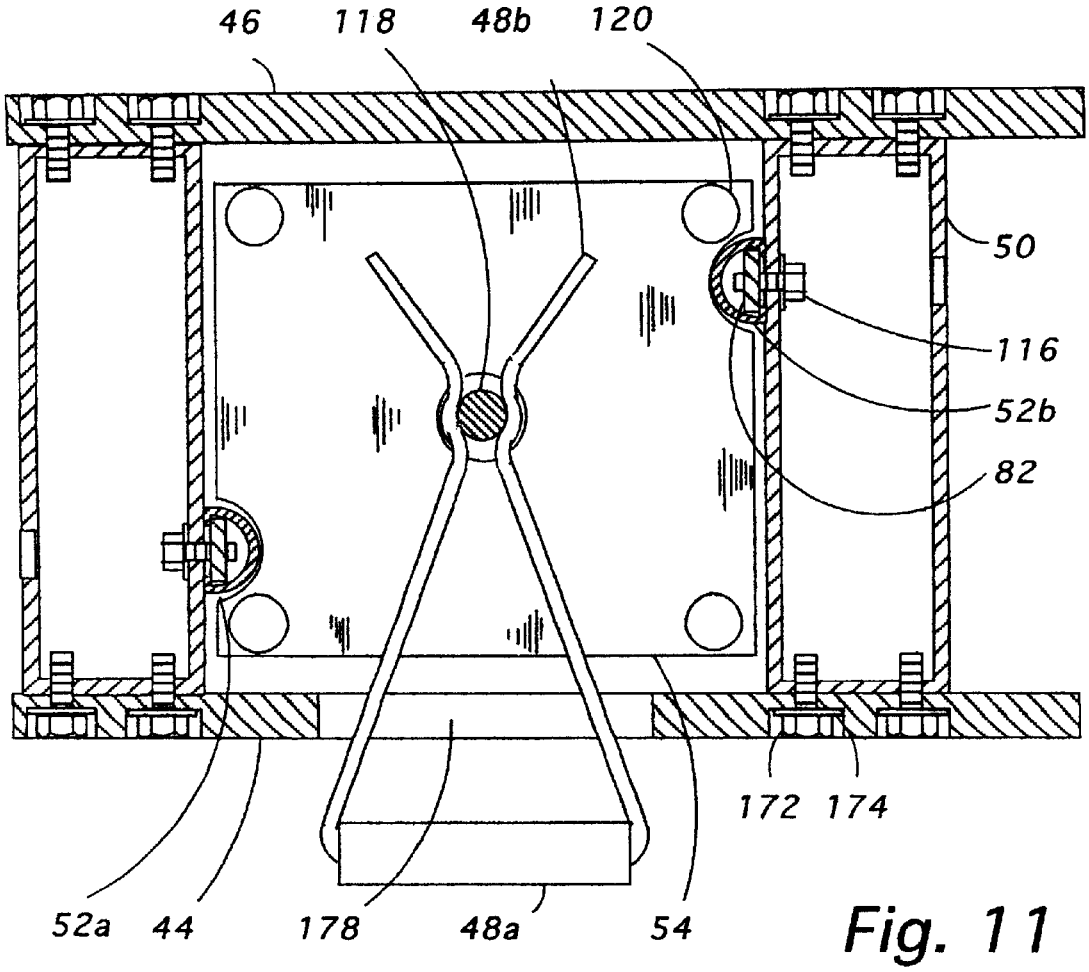
FIG. 11 is a sectional view of a module of the exercise apparatus of the present invention.

The moving weight assembly comprises weight pulley 66, its axle assembly 128, mounting bracket 126, weight anchor rod 118, weight selector 48, weights 54, and retaining clips 124. The latter are used to mount weight anchor rod 118 to the uppermost weight, and, thereby, to weight pulley 66 via mounting bracket 126. FIG. 11 complements FIG. 9, and thereby shows a horizontal section across the weight stack, at the location of weight selector 48.

Attached beneath each individual weight 54 are preferably four elastomeric bumper spacers 120. These spacers provide clearance for weight selector 48 to be inserted at a specific location on weight anchor rod 118 for choosing a specific stack of weights. Weight guides 52 on both sides of the weight stack run the full length of the weight vertical travel. The weight stack movement, at its upper end, is limited by travel stops 122.

The bumper spacers 120, together with cushions 56 at the bottom of the module frame, help noise absorption should the weight stack be released quickly or dropped accidentally. The noise from such inadvertent weight drop is very objectionable in certain environments, such as rehabilitation or recuperation areas.

Figure 10A:
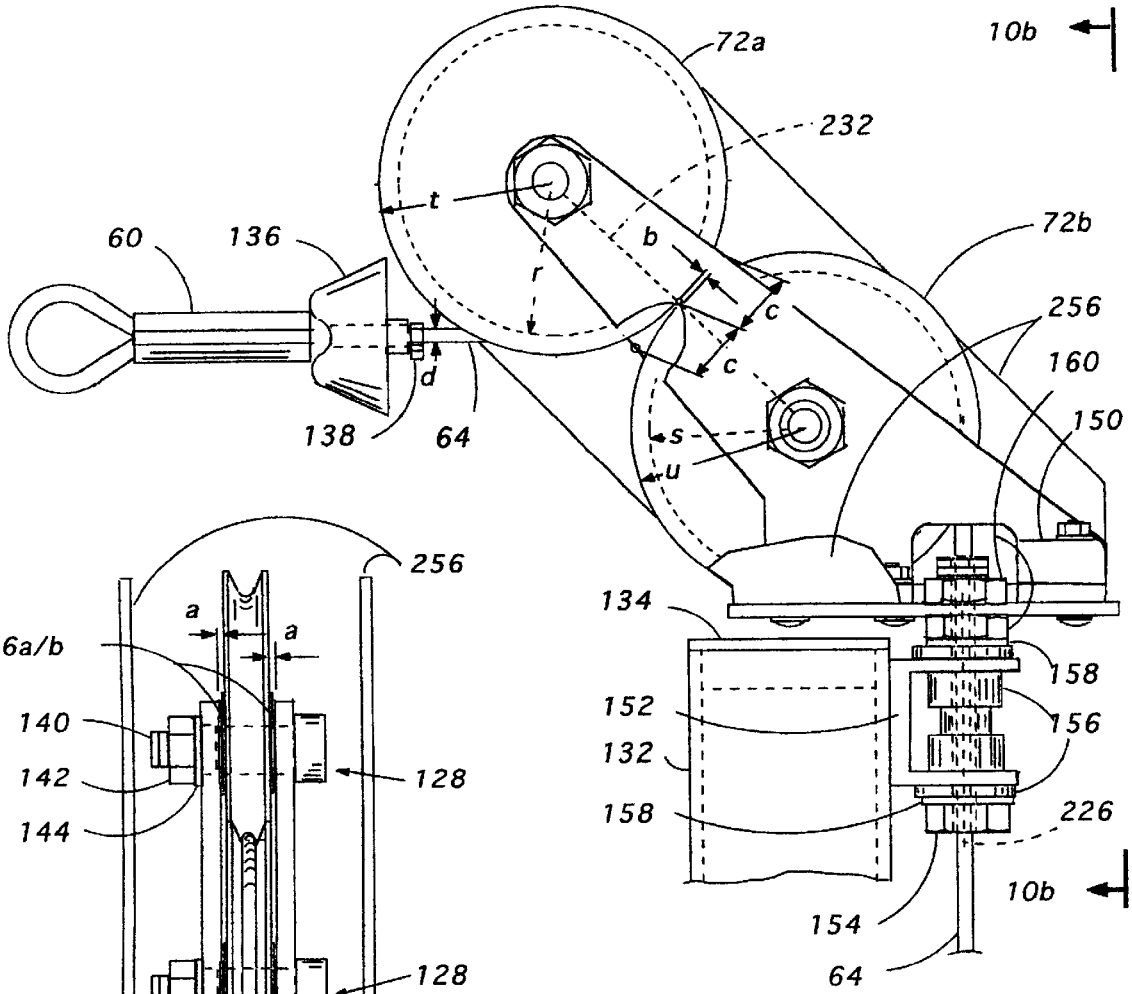
FIG. 10 is a two-sided view of an exit pulley assembly of the exercise apparatus of the present invention.
Figure 10B:
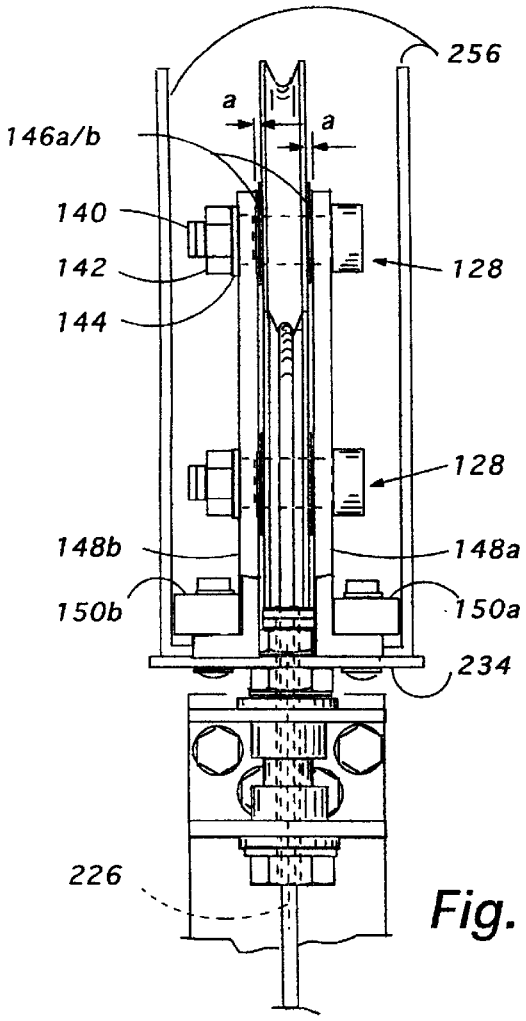

FIGS. 10*a* and 10*b* provide details of exit pulley assembly 222, its swivel mounting, and cable termination. Wire cable 64, leading alongside pivot arm 132, enters swivel center 226 of the swivel assembly, and is guided between two exit guide pulleys 72*a* and 72*b*. The cable termination forms a loop for hooking interface accessories. The cable loop is clamped by cable fitting 60. An elastomeric snubber 136 with cable retention clamp 138 prevents the cable from unraveling from between the two exit pulleys.

The function of the swiveling exit pulley assembly is to freely follow the direction of the tensile force applied through the cable at its interface with the exerciser. This function is made possible by two features: the lead of the cable through the swivel center, and by the counter weighting of the exit pulley assembly about its swivel center. For visualization of this function, one should observe that the cable force can be applied from nearly everywhere in spherical space, relative to swivel center 226. During various exercises, the pivot arm may be up or down, and the force direction may be up, down, or horizontal. This also may be seen with reference to FIG. 4.

Counter weighting effectively places the center of gravity of the swivel pulley assembly on its swivel center 226. If the swivel pulley assembly were not able to freely follow the direction of applied tension and remain there, while the tensile force is reduced or removed, then gravity would rotate the exit pulley assembly downward. If that were the case, slack in cable travel, with low tensile force, would have to be overcome the next time the exerciser applies force. That force would be different is than the force required to overcome slack. Such interaction is undesirable, since a controlled, continuous force is desired. Counter weighting, as shown, avoids slack movement.

Another feature of routing the wire cable through the center of the swivel is also necessary for always making the exit pulley assembly follow the direction of force. Two external forces to the exit pulley assembly are always applied from the cable; that is, from both ends of the cable routed through this assembly. Since the entrance end of the cable runs through the center of the swivel, its reaction force has no effective moment arm, which otherwise would induce rotation of the exit pulley assembly from this force. Having removed the gravity moment and the entrance cable force moment, the exit force moment remains the only effective one, relative to swivel center 226. Accordingly, the exit pulley assembly freely follows the direction of the applied tensile force. Friction within the swivel assembly flange bearings 156 and twist windup within the cable remain negligibly small, and do not impair this function.

Mounting bracket 152 is positioned near the capped end 134 of the pivot arm 132, so that swivel center 226, and thereby wire cable 64, are in line with the cable routing over the pivot guide pulley 70. Fixed within bracket 152 are two flange bearings 156, which support the entire exit pulley assembly. Flat washers 158 form the pivoting interface against the head of screw 154 and one lock nut 160. Screw 154 has a through-hole, of sufficiently large size to accommodate wire cable 64 moving through it. Plate 234 is captured between the two lock nuts 160. Two brackets 148*a* and 148*b* are fastened to it. They, in turn, support two exit guide pulleys 72 with axle assemblies 128. These consist of shoulder screw 140, lock nut 142, and flat washer 144. Spacer rings 146 are inserted between the brackets and keep the pulleys located, such that the dimension "a" remains within certain limits. This dimension is significantly smaller than the diameter "d" of wire cable 64. This is necessary to prevent jamming of the cable in this gap when no load is being applied.

The two counterweights 150 are of a specific mass to counterbalance the mass of exit guide pulleys 72, axle assemblies 128, and a portion of brackets 148 and shields 256 about swivel center 226.

Both sides of exit pulley assemblies 222 are covered with a protective shield 256. It is made of flexible material, and serves to prevent injury to someone accidentally bumping against the exit pulley assemblies.

Other geometric details are properly proportioned to make the exit pulley assembly function without jamming of the cable. First, located on center line 232 between pulleys, is the gap "b" between pulley outer radii "t" and "u". Dimension "b", too, needs to be significantly smaller than cable diameter "d" in order to prevent wedging of the cable in this gap. Second, the dimension "c" must be sufficiently wide, again, to lead the cable relatively straight in between the pulleys, such that the cable does not get caught within the converging outer radii "t" and "u" of the pulleys. Arrows "r" and "s" represent the pitch radii of both pulleys. Proper dimensioning and proportioning of "a", "b", and "c", relative to "d", avoids the need to place other cable lead-in devices on the exit pulley assembly. Such lead-in devices, if used, should be guides arranged perpendicular to center line 232, either fixed, contoured, low friction types, or rotating pulleys.

FIG. 11 details the module design. Module frame 50, together with panels 44, 46 substantially enclose the weight stack. Outer panel 44 has slot 178 to accommodate vertical movement of weight selector 48 with the weight stack. Screws 172 and flat washers 174 permit access to weights 54 and other supporting components. Bumper spacers 120 separate the weights from each other, and provide for a gap for inserting weight selector 48 between the weights.

Weight selector 48 consists of a handle 48*a* and two prong-like springs 48*b*. These prongs have two purposes. First, they are biased toward the center of weight anchor rod 118, and lock themselves in hairpin-like action around the narrowed stem portions of weight anchor rod 118. Second, the shape of the springs 48*b* is spread out, so that the weight is evenly supported by them, while being held level at the same time. This prevents the weights from tilting while being moved up and down, and from possibly jamming between weight guides 52.

Two cut-outs in each weight 54 are used for mating with two opposite weight guides 52. The weight guides 52 run nearly the full vertical length of the space within the module. They preferably are made of a low friction plastic extrusion and are bolted against the module frame 50 at regular intervals with nut strips 82. The weights and weight guides are fit loosely together, allowing a small amount of lateral float while the weight stack is traveling. This avoids the cost of expensively machined and precision aligned weight guides having dual circular guidance rod and bushing designs, which are normally used in prior art devices.

Figure 12:
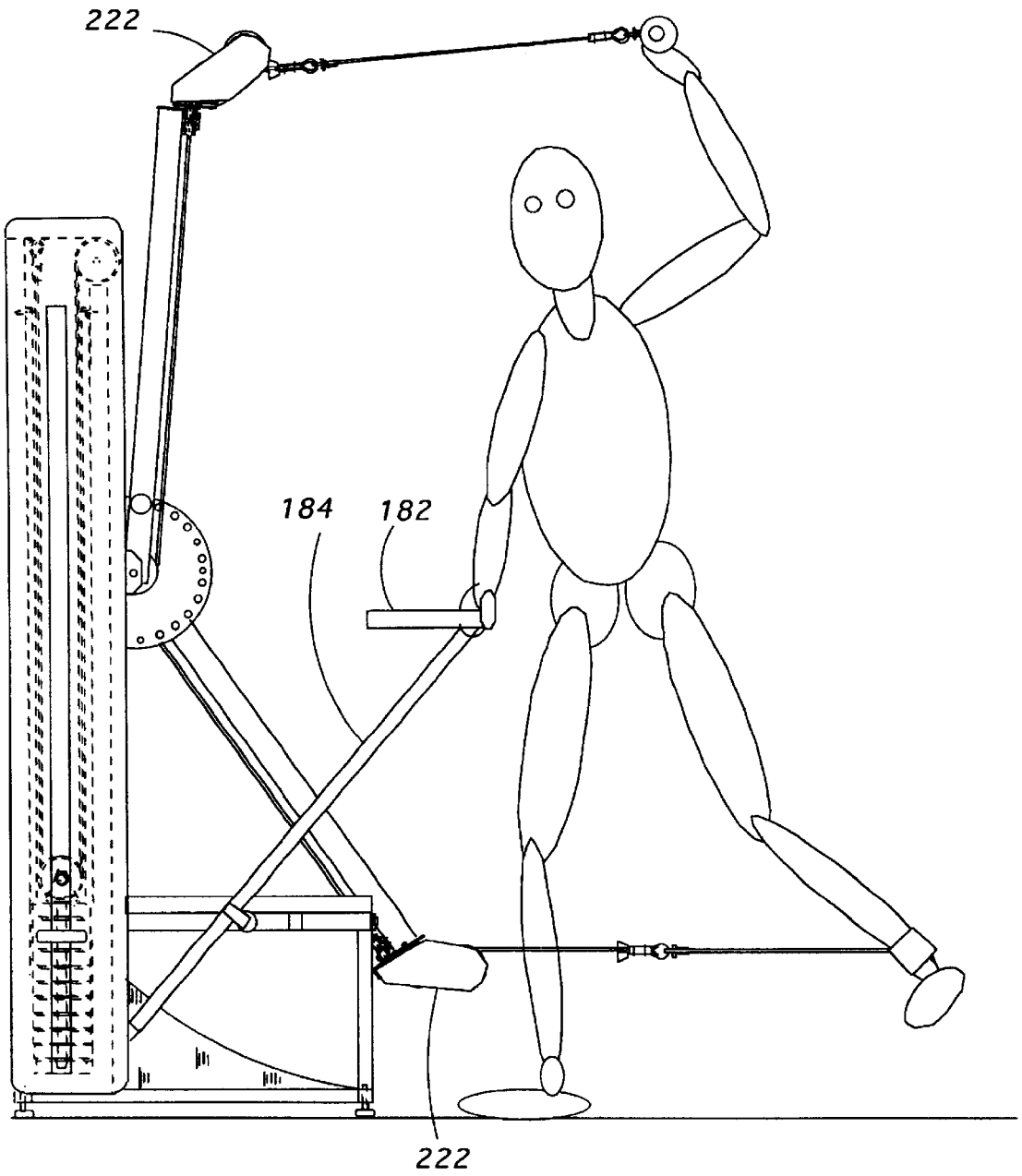
FIG. 12 is a side view of a standing person exercising two limbs, while stabilizing against the frame of the exercise apparatus of the present invention.

The operation of apparatus 20 by a standing exerciser is illustrated in FIG. 12. While steadying himself against handle bar 182 and frame member 184, one arm and one leg are exercised. The two pivot arms are shown in up and down position, while exit pulley assemblies 222 are oriented in the direction of cable pull.

In FIG. 13, one pivot arm is set in a high position, the other in a low position. The exerciser is in a supine position and works both legs while bracing himself against handles 164 of seat extension 40. His right leg is attached to wire cable 64 via foot strap 224 and cable extender 74. This configuration permits leg rotation about the hip, while making use of the full available cable travel. The other leg is bent at the knee, and placed beside the seat extension. Such an exercise configuration is particularly useful for hip replacement rehabilitation.

Cushions may be strapped to the frames of seat 38 and seat extension 40 with cooperating hook-and-loop fasteners 216, so that cushion covers 204 may be cleaned or replaced. The strap closure mechanism may be snap-in grommet or hook-and-loop type fasteners.

The seat extension construction includes leg folding hinge 240 and guide tube 170 with locking pin 168. Handle 164 is inserted within guide tube 170, while its position is fixed via locking pin 168. FIG. 5 provides additional details of construction.

Figure 14:
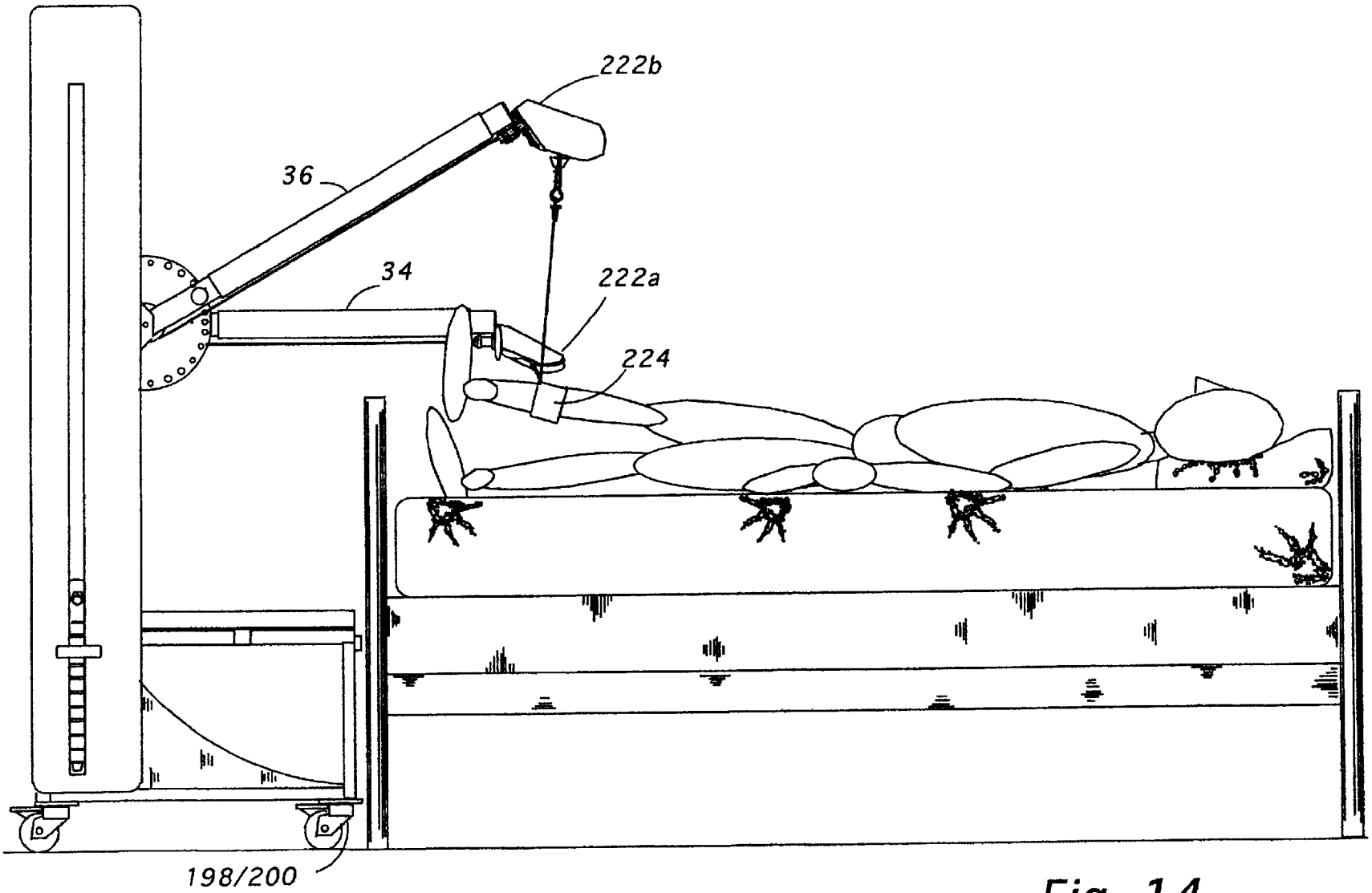
FIG. 14 is a view of a bed-confined person with one leg suspended, further demonstrating use of the exercise apparatus of the present invention to exercise in sideways motion.

In FIG. 14, the leveling screws are replaced by casters 198. This provides mobility of the apparatus for use by a bed-confined patient, or for other reasons of convenience. In this illustration, arm assembly 36 with exit pulley assembly 222*b* is used to keep one leg slightly elevated, and above the mattress. The other arm assembly 34 is placed horizontally and to the side of the leg. Exit pulley assembly 222*a* is oriented in the direction of foot strap 224. For this particular exercise, the weight stack associated with arm assembly 36 is set to support the weight of the leg. The other weight stack setting is for the desired resistance force for lateral leg movement.

Two properties must be inherent in the casters in order to lock the apparatus in place against rolling from the applied exercise forces, and to provide the same stability as the leveling screws. The wheels must exhibit high friction with the floor, and the rolling and swivel motion of the casters must be locked or bypassed. The wheels preferably are made of flexible neoprene or a similar elastomer with high sliding friction. Commercial casters are available with universal lock 200, whereby simultaneously wheel rotation and caster swivel are locked. Alternately, a jack type floor lock can be used, serving to raise the entire apparatus and, thereby, the casters sufficiently far to break rolling contact with the floor.

Figure 15:
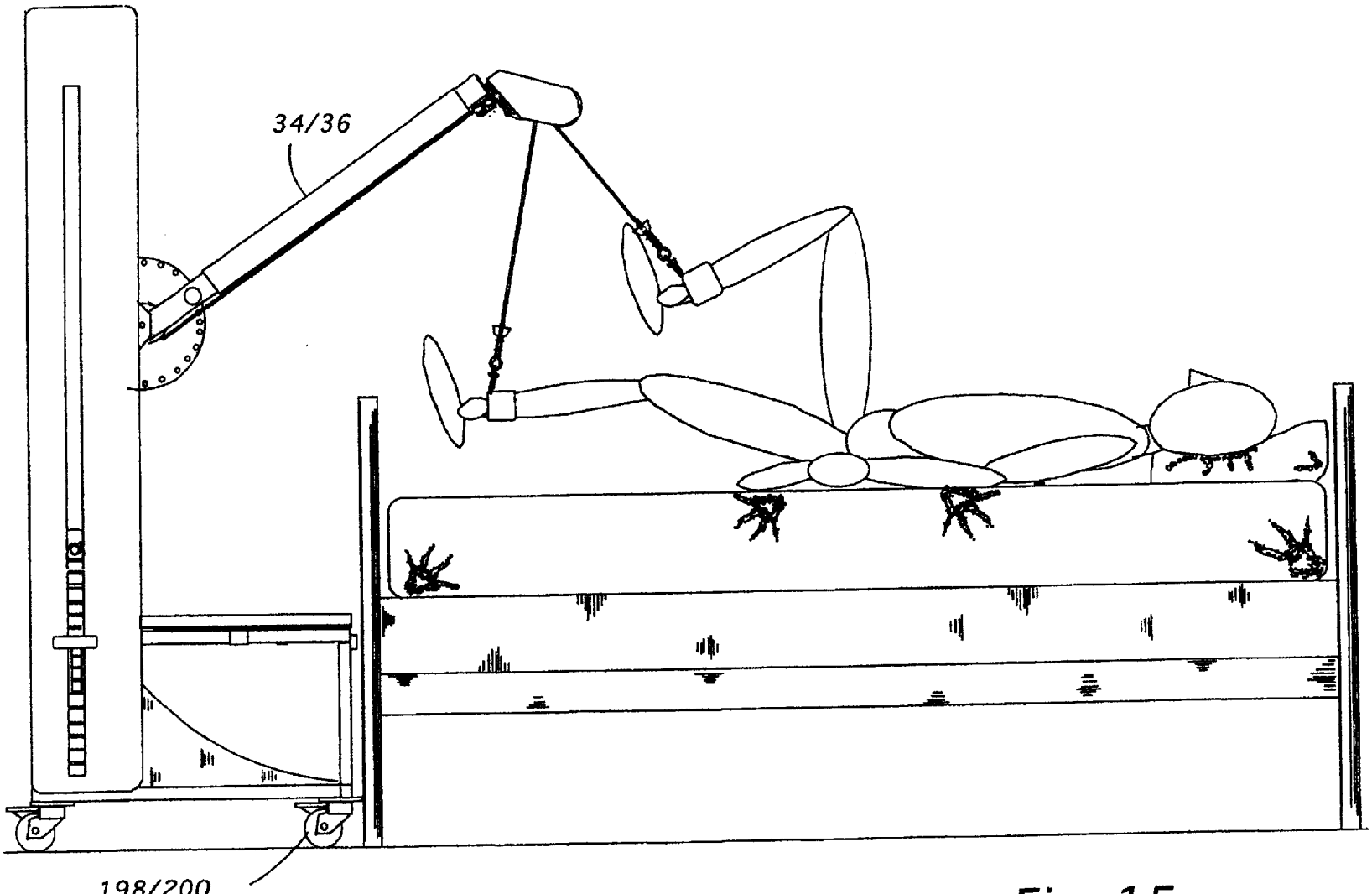
FIG. 15 is a view of a bed-confined person, with both legs suspended, further demonstrating use of the exercise apparatus of the present invention to exercise in a bicycling motion.

FIG. 15, illustrates use of the exercising apparatus 20 moved in place on casters 198/200 for someone lying in bed. Both arm assemblies 34, 36 are positioned at the same elevation angle above the legs. In the azimuth position, the pivot arms are oriented next to each other. Each leg is supported by cuffs, which are attached to the wire cables. The leg exercise simulates a bicycling motion.

In case of exercises for children, apparatus 20 can be modified to counter possible apprehensions of medical devices. Cut-outs of suitable material, such as a friendly cartoon figure head 236, are fastened to frame 22.

Figure 17B:
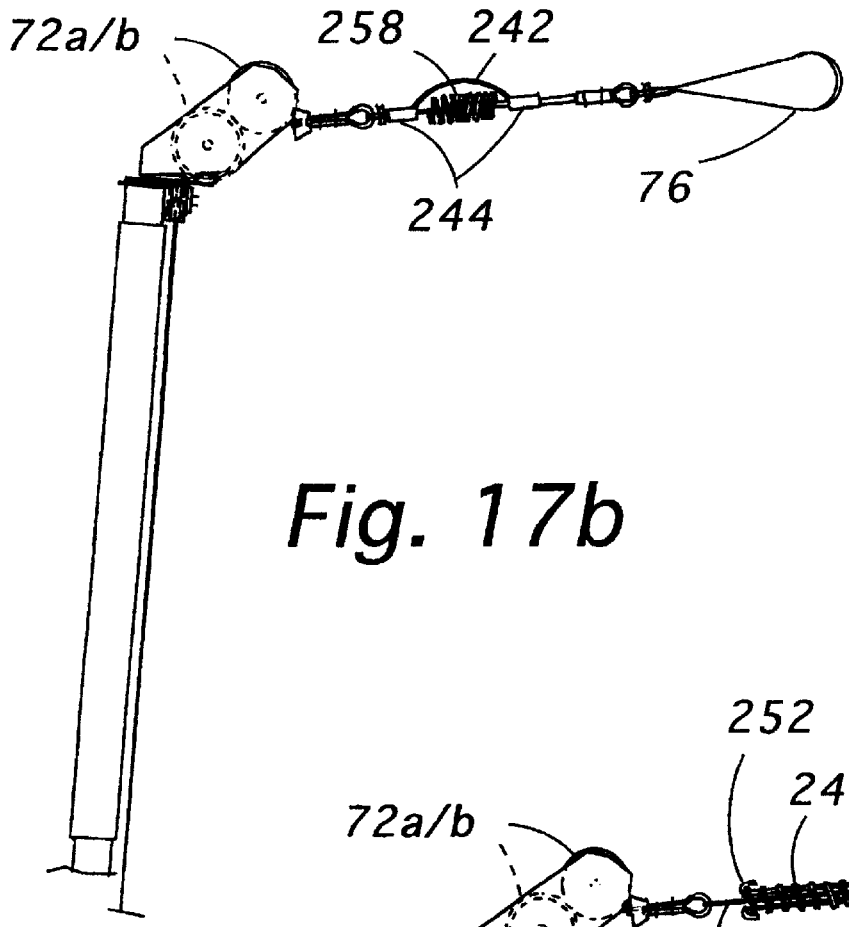
FIGS. 17*a* and 17*b* are spring assemblies, inserted between cable end fitting and handle assembly of the exercise apparatus of the present invention.
Figure 17A:
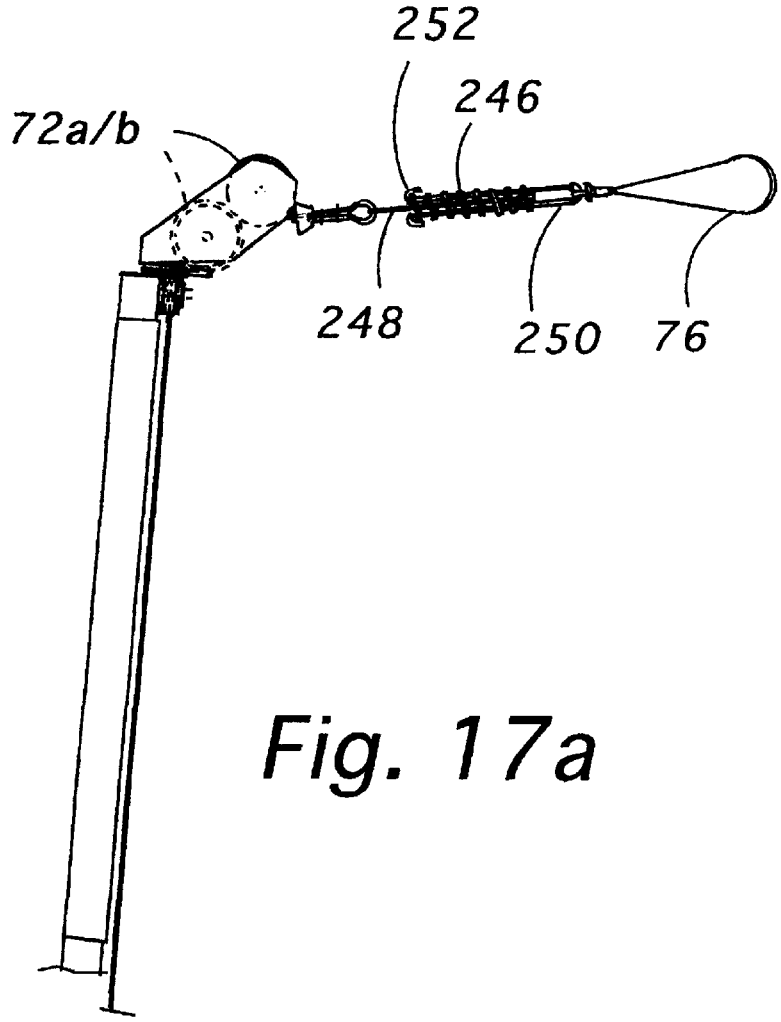

Generally, FIGS. 17*a* and 17*b* show a spring assembly inserted between a cable end fitting and an exercise handle 76. The cable exits from between both exit guide pulleys 72*a*/*b*. The spring assembly functions to gradually increase the load felt by the operator, without a quick ramp-up in loading, when the weight stack is being lifted off its rest position.

Specifically, FIG. 17*a* shows a compression spring assembly, versus a tension spring assembly in FIG. 17*b*. Both designs provide the characteristics of gradual force application. Both are configured so that accidental breakage of the spring does not result in separation and dropping of the weight. Compression spring 246 is captured by two hook end fittings 248, 250, allowing tensile forces to be transmitted across the spring. Both end fittings are inserted from opposite ends of the spring and capture the spring by means of hook ends 252. The hook end fittings 248, 250 also are offset 90 degrees from each other, to make them fit inside the diameter of the compression spring.

In FIG. 17*b*, tension spring 258 is bridged by a slack length of the cable loop 242. Loop 242 joins with the ends of the tension spring via clamp fittings 244. Once the tension spring is elongated to its design limit length, the cable is stretched, and the load is transferred to the cable bridge. In this way, the spring cannot be overloaded, nor can the tensile load be dropped across the spring assembly, were the spring to fail accidentally.

Figure 18:
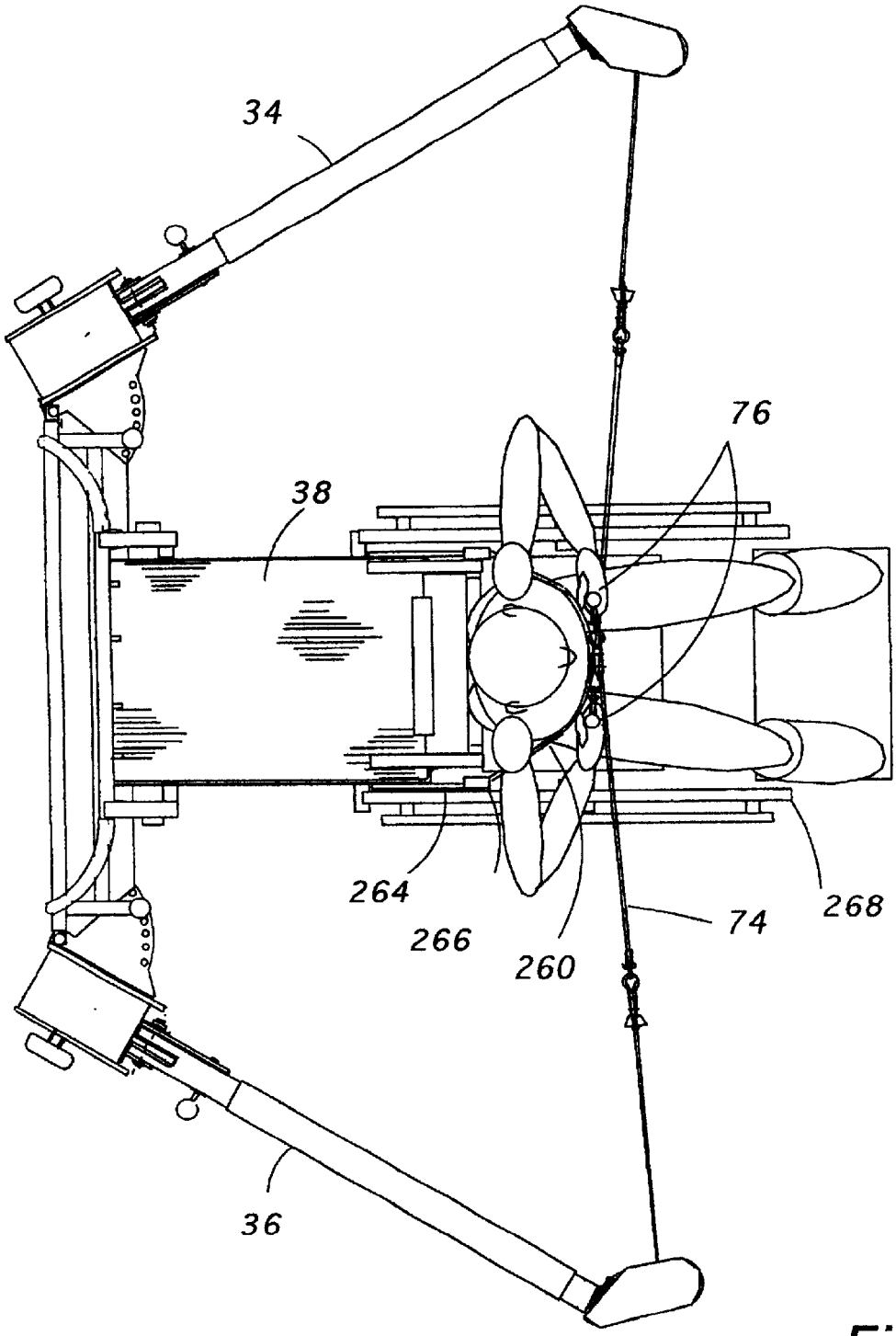
FIG. 18 is a top view of a wheel chair patient, performing a horizontal shoulder stretch upon the exercise apparatus of the present invention; and, FIG. 19 is a side view of the exercise apparatus of the present invention, further demonstrating use thereof by a wheelchair-confined person, whereby one arm assembly with cuff is used to remove natural gravity force from the knee portion of the leg, and where the other arm assembly with cuff provides resistance force at the ankle, all during a leg curl exercise.

Wheelchair 268 access to apparatus 20 is illustrated in FIG. 18. The individual is strapped against the seat 38 with a seat belt 260. A swivel-mounted leafspring-like flexure strap 264 and buckle 266 on both sides of the seat provides easy attachment of the seat belt. In this Figure, the patient is positioned for a shoulder stretch exercise. Handles 76 and cable extender 74 cross in front of the chest, while tensile force is exerted in gripping the handles and rotating the shoulders backward. Arm assemblies 34, 36 are positioned so that the exit pulley assemblies are approximately in line with the sideways horizontally outstretched arms.

Figure 19:
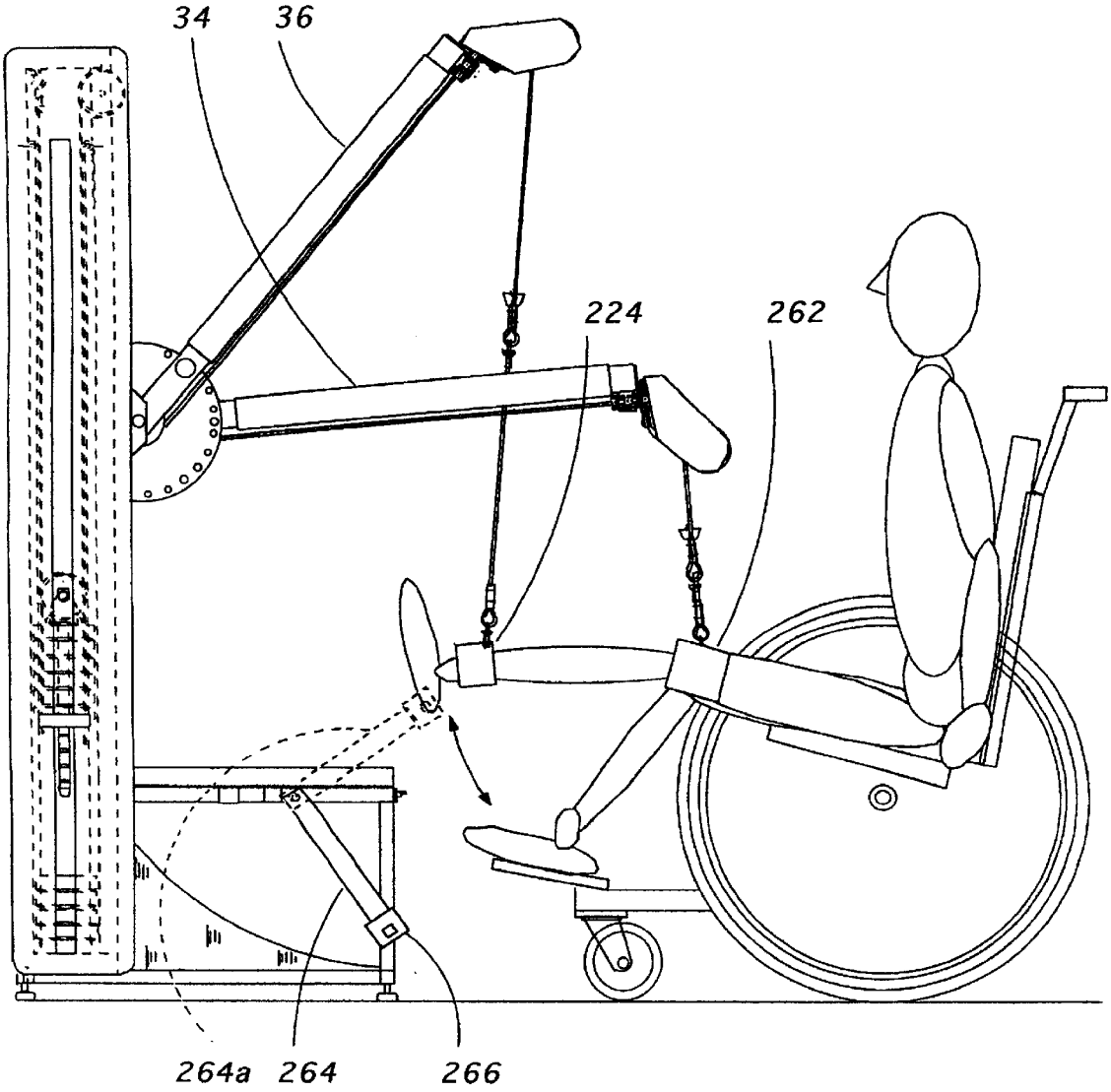

FIG. 19 depicts a wheelchair-based exercise somewhat similar to that shown in FIG. 14. The wheelchair faces the apparatus and is not tied to it. Flexure strap 264 with buckle 266 is rotated downward and out of the way from its earlier position 264*a*.

Arm assembly 34 is placed horizontally, and supports the patient's knee with knee cuff assembly 262. Arm assembly 36 is raised, but placed in azimuth orientation close-in to the other arm assembly. The lower leg can now be rotated about the knee joint, while resistance force is applied from foot strap 224, via arm assembly 36.

This exercise, too, gives a wheelchair-bound patient a unique leg curl motion for a typically weakened or immobile muscle group and joint. The exercise is uniquely made possible by this apparatus.

The wide range of motion provided by the apparatus of the present invention, along with its ability to provide a great variety of exercises, are attributable to the combined function of the gimbal-like adjustments in azimuth and elevation; two separate, fairly long arm assemblies 34, 36; fully swivelable cable exit pulley assemblies 222; long cable travel; and, a wide range of force settings.

Advantageously, only slot 178 makes visible the up and down-moving weight stack. The module enclosure enhances aesthetics and operator safety, as well as the cleanliness of the apparatus, which is desired for use in a rehabilitation hospital. The modules are simply mounted to frame 22 with two hinge pins 28 and 30 and an azimuth position locking pin 32, which is easily accessible at a convenient height above the floor.

The angular orientation of the pivot arms can be set from nearly vertically up to down, near the floor. This enables application of operator induced forces at all is height levels. Both arms can be independently set, or placed at the same height. When both arm assemblies 34, 36 are also placed parallel to each other, or even in 'toe-in' fashion, both cables from the exit pulley assemblies can be hooked together on one handle bar, or another similar device. In that way, the applied force is twice the force available from only one arm and module.

Further advantageously, the design of the spring applied locking pin 92 engagement in the elevation locking plate 78 is fail safe. It prevents accidental dropping of the arm assemblies 34, 36, contrasted with, for example, a similar device utilizing a separate pin needing to be manually engaged.

Insertion of a spring within the cable length permits gradual force application. This can prevent unnecessary strain and pain for a weak person, who is trying to regain strength and mobility. This need for low and slow force application is also beneficial where the exercise requires extended reach or rotation of a limb. In those extreme positions, the limb is often weak, as compared with a close-to-the-body or center-of-motion range position. For exercisers with weak finger strength, a no-grip handle 76 is available, which slips around the wrist.

The built-in stabilizer frame 42 can be unfolded from its retracted position against the frame 22 and be securely locked in place with a latching lock 186. Note, that sufficient clearance exists between frame member uprights 184 and the seat frame 202, to prevent operator pinch points while the frame is being unstowed or stowed. The purpose of the stabilizer frame 42 is to serve as body and hand hold for a standing person during exercise. Supporting body balance against exercise forces is particularly beneficial to weak and unsteady individuals. The exerciser can use the frame while facing the exercise apparatus, facing the opposite direction, or standing sideways.

A person on the seat extension may feel the need to react to forces applied to limbs or the torso. Rather than grasping the sides of the seat extension frame, or hoping for sufficient friction against the cushion, the exerciser benefits from having a rigid hold on the handles 164. A sense of security will result in higher concentration on the exercising itself.

Since forces can be applied from all directions, relative to the end of the pivot arm, it is imperative, that the exit guidance feature (i.e., the exit pulley assemblies 222) freely follows the force. Otherwise, is snagging of the cable within the exit pulley assembly could result. Furthermore, if an uncontrolled orientation of the swivel assembly were to occur during cable retraction, or when the applied force is relatively small, then slack and unsteady cable motion, with uneven force levels would make the operator feel uneasy and annoyed. This must absolutely be avoided for operators and rehabilitation patients, who are physically insecure and unsteady. The features of guiding the cable through the swivel center and counter weighting the exit pulley assembly make possible the free and unhindered orientation of the cable toward the direction of applied force.

The caster mounted apparatus can be moved freely on a reasonably even floor. With the arms in the up or down position, it can pass through average width door. This provides access to a bed confined patient. Resistance exercising in bed can be a very beneficial part of physical therapy in injury and post-surgical cases. After joint replacement operations, when muscle atrophy threatens inactive patients, low resistance exercises can be very useful. FIGS. 14 and 15 show exercises of legs, that are made possible by this apparatus. Similarly, an arm, the upper torso, or the head/neck can be exercised with appropriate arrangement of both pivot arms. Note that in FIG. 14 one pivot arm is simply used to elevate a limb and suspend it above contact with the mattress. A weakened patient may not be able to raise the limb any other way while attempting sideways exercise, as illustrated here. The limb motion may also be spatial rotation, rather than planar.

The combined features of wide adjustability of both arm assemblies 34, 36, together with the modules 24, 26, provide far reach away from the footprint of frame 22, and, thereby, provide the spatially unconfined direction and application of the cable forces to provide special exercises for bed and wheel chair confined patients. Both, muscle strengthening and joint movement are important. The result of extended immobility are bedsores and reduced circulation. The exercises of FIG. 19 and FIG. 14 enable the limbs to be lifted from their rest positions and to be moved freely in many directions in order to avoid those problems.

The shoulder stretch shown in FIG. 18 is made possible by placing both cable exits of the arm assemblies at a person's shoulder height and opposite each other. This requires a wide space between the cable exits. Such a is feature can only be duplicated with other exercise machines when two separate are machines are placed to the left and right of the person. The invention provides such rehabilitation exercise with one apparatus.

It should now be clear that the weight exercise apparatus of the present invention provides unprecedented versatility in the field of rehabilitation and therapy, and that it is equally suitable for recreational exercising.

The invention also can be reduced or expanded in its basic features, while still maintaining its basic configuration and functioning. For example, the seat extension 40 and/or handles 164 optionally may not be used if, for example, the only user were a wheelchair bound person; the stabilizer frame 42 may not be used if, for example, the user were not able to use the apparatus in a standing position; only one module 24 or 26 with arm assembly 34 or 36 may be used, if such an apparatus were limited in its use to one limb at a time.

Similarly, the apparatus' manual adjustments and position locking in azimuth and elevation may be replaced by an electrically or otherwise powered mechanism, such adjustments being selected with a handheld controller, either through a cable or a wireless remote control, in order better to accommodate physically limited and constrained users.

Further and additional modifications may be made without departing from the scope of the present invention. For example, counterweights 208 in frame 22 may not be used, if all or some structural material were made heavy so that the stability toward overturning or horizontal rotation is maintained; counterweights 208 may also be unnecessary, if the apparatus' structure were firmly anchored to the floor or a wall or a similar support; weight 54 selection and the locking to the weight anchor rod 118 may be done with a conventional pin inserted in holes through both the weights and weight anchor rod; the weight guides 52 may be replaced by conventional round guide rods through the weights and the weights be furnished with guide bearings for moving up and down on the guide rods; the cable and pulley arrangement may be modified to change the above-described ratio of 2:1 for cable travel and weight selection versus cable termination forces and weight vertical travel; the exit pulley assembly 222 may use a different method of guiding the wire cable, other than by providing brackets 148 with specific dimensions and geometry; the wire cable 64 may be relocated from the outside of pivot arm 132 to inside its tubular cross-section; the wire cable 64 may be replaced by a flat ribbon of suitable material; frame 22 and module frames 50 may not use panels, which enclose the frames on one or both sides; and, seat 38 and seat extension 40 may have various heights above the floor for most comfortable use by persons of different stature or height, the height settings thereof being varied by any of several means, such as by screw adjustment of leveling feet, by placing or removing spacers under the seating surfaces, by placing or removing spacers between leveling feet or casters and the seat structure, or by varying the seat structure.

Having thus described exemplary embodiments of the present invention, it should be noted by those skilled in the art that the within disclosures are exemplary only and that various other alternatives, adaptations, and modifications may be made within the scope of the present invention. Accordingly, the present invention is not limited to the specific embodiments as illustrated herein, but is only limited by the following claims.

We claim:

1. A multi-choice exercise apparatus comprising:

a structure comprising a chair, said chair being affixed to a frame having a forward portion and a rearward portion, a first and a second side; two modules separated from each other by said frame, each said module comprising a weight stack and a weight stack enclosure;

each said module further comprising an azimuth locking plate affixed to a side of said weight stack enclosure, and a hinge pin disposed rearward of said azimuth locking plate, said hinge pin defining a vertical axis of rotation of said module thereabout, said hinge pin interconnecting said module to said rearward portion of said frame at a side of said frame, said frame supporting said module;

each said module being individually pivotable about its said vertical axis of rotation; and, weight stack lifting means carried by a forward portion of each said weight stack enclosure, said weight stack lifting means being pivotable with said module about said vertical axis of rotation;

whereby the apparatus enables a user thereof to exercise separate limbs at the same time, but in optionally differing planes and with optionally differing resistance, all within a near hemispherical space.

2. The apparatus of claim 1 wherein said weight stack lifting means comprises an arm, a cable, and a pulley.

3. The apparatus of claim 2 wherein said cable and pulley rotatably follow a direction of application of tensile force through said cable and along said arm by a user interacting therewith.

4. The apparatus of claim 3 wherein said cable and pulley rotatably follows the direction of application of tensile force along said arm through an attached swiveling exit pulley assembly, said exit pulley assembly comprising a pivot center, said exit pulley assembly further comprising two pulleys to guide cable exiting between them, said cable running through the pivot center of said assembly.

5. The apparatus of claim 4 further comprising a counterweight positioned rearward of said exit pulley assembly so as to define a center of gravity of said assembly and to place said center of gravity on an axis through the pivot center of said exit pulley assembly.

6. The apparatus of claim 2 wherein said weight stack lifting means further comprises a user interface tool.

7. The apparatus of claim 2 wherein said arm and cable are of length to extend, in a first position, vertically from a user's outstretched arms overhead, to a second position, wherein an end of said arm is proximate a floor supporting the apparatus, and horizontally, in an arc of at least 30 degrees about said hinge pin, in order to effect application of force between said apparatus and a user thereof, the user being in any of a variety of optional positions.

8. The apparatus of claim 2 wherein said arm and cable are rotatable, and optionally selectively fixed into position, throughout a nearly hemispherical space.

9. The apparatus of claim 2 further comprising spring means in line with said cable for gradual application of force between the user and the apparatus.

10. The apparatus of claim 2 wherein said arm further comprises an axis of rotation, the length of said arm reaching from said axis of rotation to a clearance distance above a surface supporting the apparatus.

11. The apparatus of claim 2 wherein the width between each vertical axis of rotation of said weight modules is less than the length of said arm.

12. The apparatus of claim 2 wherein said cable has a length greater than the length of said arm.

13. The apparatus of claim 1 wherein said weight stack lifting means further comprises a weight selector and a weight anchor rod, said weight anchor rod comprising spaced-apart recesses, said weight selector comprising a handle and spread apart prongs, said prongs being biased toward the center of said weight anchor rod, said prongs further being capable of locking in hairpin-like action about said spaced-apart recesses of said weight anchor rod.

14. The apparatus of claim 1 further comprising leveling means.

15. The apparatus of claim 14 wherein said leveling means comprises casters.

16. The apparatus of claim 14 wherein said leveling means comprises leveling screws.

17. The apparatus of claim 1 further comprising user stabilizer means.

18. The apparatus of claim 17 wherein said user stabilizer means comprises a bar.

19. The apparatus of claim 17 wherein said user stabilizer means comprises a waist belt.

20. The apparatus of claim 1 wherein each of said weight modules may be selectively locked about its vertical axis of rotation.

21. The apparatus of claim 1 further comprising a deadweight attached to said frame rearward of said frame.

22. The apparatus of claim 1 further comprising a seat extension.

23. The apparatus of claim 22 further comprising a bracing handle.

24. The apparatus of claim 23 wherein said bracing handle is movable into an alternate position for the user's convenience in stowing the apparatus.

25. A multi-choice exercise apparatus comprising:

a structural frame comprising a forward portion and a rearward portion, a first side and a second side, and a chair, said chair structurally affixed intermediate to said first and second sides so as to serve as a stiffening brace for said frame;

two weight modules separated from each other by said frame, each said module comprising a weight stack and a weight stack enclosure;

each said module further comprising an azimuth locking plate affixed to a side of said weight stack enclosure, and a hinge pin disposed rearward of said azimuth locking plate, said hinge pin defining a vertical axis of rotation of said weight module thereabout, said hinge pin interconnecting said weight module to said rearward portion of said structural frame at a side of said frame, said frame supporting said weight module;

each said module being individually pivotable about its said vertical axis of rotation; and, weight stack lifting means carried by a forward portion of each said weight stack enclosure, said weight stack lifting means being pivotable with said module about said vertical axis of rotation;

whereby the apparatus enables a user thereof to exercise separate limbs at the same time, but in optionally differing planes and with optionally differing resistance, all within a near hemispherical space.

26. The apparatus of claim 25 wherein said weight lifting means further comprises a weight selector and a weight anchor rod, said weight anchor rod comprising spaced-apart recesses, said weight selector comprising a handle and spread apart prongs, said prongs being biased toward the center of said weight anchor rod, said prongs further being capable of locking in hairpin-like action about said spaced-apart recesses of said weight anchor rod.

27. The apparatus of claim 25 wherein said weight lifting means further comprising a freely swiveling exit pulley an arm, a cable, and a user interface tool.

28. The apparatus of claim 27 wherein said arm further comprises an axis of rotation, the length of said arm reaching from said axis of rotation to a clearance distance above a surface supporting the apparatus.

29. The apparatus of claim 27 wherein the width between each vertical axis of rotation of said weight modules is less than the length of said arm.

30. The apparatus of claim 27 wherein said cable has a length greater than length of said arm.

31. The apparatus of claim 27 further comprising a counterweight positioned rearward of said exit pulley assembly so as to define a center of gravity of said assembly and to place said center of gravity on an axis through the pivot center of said exit pulley assembly.

32. The apparatus of claim 25 wherein each of said weight modules may be selectively locked about its vertical axis of rotation.

33. The apparatus of claim 25 wherein each of said weight stack lifting means may be selectively locked about a horizontal axis of rotation of said weight stack lifting means.

34. The apparatus of claim 25 further comprising a deadweight disposed rearward of said frame.

35. The apparatus of claim 25 further comprising a seat extension.

36. The apparatus of claim 35 further comprising a bracing handle.

37. The apparatus of claim 36 wherein said bracing handle is movable into an alternate position for the user's convenience in stowing the apparatus.

38. An exercise apparatus comprising a structural frame comprising a forward portion and a rearward portion, a first side and a second side, and a chair, said chair structurally affixed intermediate to said first and second sides so as to serve as a stiffening brace for said frame; two weight modules separated from each other by said frame, each said module comprising a weight stack and a weight stack enclosure; each said module further comprising an azimuth locking plate affixed to a side of said weight stack enclosure, and a hinge pin disposed rearward of said azimuth locking plate, said hinge pin defining a vertical axis of rotation of said weight module thereabout, said hinge pin interconnecting said weight module to said rearward portion of said structural frame at a side of said frame, said frame supporting said weight module; each said module being individually pivotable about its said vertical axis of rotation; weight stack lifting means carried by a forward portion of each said weight stack enclosure, said weight stack lifting means being pivotable with said module about said vertical axis of rotation; said weight lifting means further comprising a freely swiveling exit pulley, an arm, a cable, and a user interface tool.

* * * * *